US010928772B2

(12) United States Patent
Tominaga et al.

(10) Patent No.: US 10,928,772 B2
(45) Date of Patent: Feb. 23, 2021

(54) IMAGE FORMING APPARATUS HAVING A HUMIDIFICATION SECTION

(71) Applicant: FUJI XEROX CO., LTD., Tokyo (JP)

(72) Inventors: Yoshiyuki Tominaga, Kanagawa (JP); Masaaki Yamaura, Kanagawa (JP); Jun Kuwabara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/545,369

(22) Filed: Aug. 20, 2019

(65) Prior Publication Data

US 2020/0301359 A1 Sep. 24, 2020

(30) Foreign Application Priority Data

Mar. 19, 2019 (JP) ..... 2019-050684

(51) Int. Cl.
*G03G 21/20* (2006.01)

(52) U.S. Cl.
CPC ..... *G03G 21/203* (2013.01)

(58) Field of Classification Search
None
See application file for complete search history.

(56) References Cited

U.S. PATENT DOCUMENTS 5,884,134 A * 3/1999 Karashima ..... G03G 15/165 399/315
2010/0061750 A1* 3/2010 Okada ..... G03G 15/169 399/55
2013/0294792 A1* 11/2013 Hara ..... G03G 15/1665 399/66
2017/0277120 A1 9/2017 Miyoshi

FOREIGN PATENT DOCUMENTS

JP 10-048965 A 2/1998
JP 2008-065025 A 3/2008
JP 2017-173510 A 9/2017

OTHER PUBLICATIONS

JP 2008-065025 MachineTranslation, Japan, 2008, Miyazaki.*

* cited by examiner

*Primary Examiner* — Victor Verbitsky
(74) *Attorney, Agent, or Firm* — Sughrue Mion, PLLC

(57) ABSTRACT

An image forming apparatus includes: an image holding section; a transfer section that has a transfer member, applies a transfer electric-field to a transfer region between the image holding section and the transfer member, and electrostatically transfers an image held by the image holding section onto a recording medium; contact sections that act as electrodes to ground while being in contact with the recording medium; a humidification section that is provided upstream of the transfer region and humidifies the recording medium; a first control section that performs control without humidification by the humidification section; a second control section that performs control to cause the humidification section to humidify the recording medium; and a selection section that selects the first control section or the second control section depending on a type of the recording medium.

13 Claims, 18 Drawing Sheets

IMAGE FORMING APPARATUS HAVING A HUMIDIFICATION SECTION

CROSS-REFERENCE TO RELATED APPLICATIONS

This application is based on and claims priority under 35 USC 119 from Japanese Patent Application No. 2019-050684 filed Mar. 19, 2019.

BACKGROUND

(i) Technical Field

The present disclosure relates to an image forming apparatus.

(ii) Related Art

In the related art, as image forming apparatuses, for example, image forming apparatuses described in Patent JP-A-2008-65025, JP-A-2017-173510, and JP-A-1998-48965 are already known.

JP-A-2008-65025 (FIGS. 2 and 7 in DETAILED DESCRIPTION) discloses a technology of providing a medium thickness measuring unit, a resistance measuring unit, and a humidifying unit, calculating a volume resistivity of a recording medium based on a thickness and a resistance value of the recording medium, applying a voltage optimum for transferring a toner image based on the thickness and the volume resistivity of the recording medium, and performing control so as to humidify a recording medium having a high volume resistivity and not to humidify a recording medium having a low volume resistivity.

JP-A-2017-173510 (FIG. 8 in DETAILED DESCRIPTION) discloses a technology of performing transfer control by constant current control using a predetermined transfer current in a case where humidity exceeds a predetermined humidity range, and performing transfer control by constant voltage control using a transfer voltage calculated from a system resistance of a pair of rolls in a case where the humidity is within the predetermined humidity range.

JP-A-1998-48965 (FIG. 4 in DETAILED DESCRIPTION) discloses a technology of switching between control by a constant current control mechanism in a case where a resistance value of a transfer section is within a high resistance range and control by a constant voltage control mechanism in a case where the resistance value of the transfer section is within a low resistance range.

SUMMARY

Aspects of non-limiting embodiments of the present disclosure relate to keeping, in a proper range, the transfer electric-field in the transfer region, even when different types of recording media intended to pass through the transfer region of a transfer section include a low transferability type, in contrast to a case where humidification of the recording medium by a humidification section is not performed.

Aspects of certain non-limiting embodiments of the present disclosure address the features discussed above and/or other features not described above. However, aspects of the non-limiting embodiments are not required to address the above features, and aspects of the non-limiting embodiments of the present disclosure may not address features described above.

According to an aspect of the present disclosure, there is provided an image forming apparatus including: an image holding section that holds an image;

a transfer section that includes a transfer member disposed in contact with an image holding surface of the image holding section and an opposite member disposed at a position facing the transfer member across the image holding section, connects a transfer power supply to the opposite member to apply a transfer electric-field to a transfer region between the image holding section and the transfer member, and electrostatically transfers the image held by the image holding section onto a recording medium transported to the transfer region;

contact sections that are provided upstream and downstream of the recording medium a direction of transport of the recording medium across the transfer region and act as electrodes to ground while being in contact with the recording medium when the recording medium passes through the transfer region; a humidification section that is provided upstream of the transfer region in the direction of transport of the recording medium and humidifies the recording medium; a first control section that performs control to transfer the image on the image holding section to the recording medium without humidification by the humidification section; a second control section that performs control to cause the humidification section to humidify the recording medium, to transport the humidified recording medium to the transfer region, and to transfer the image on the image holding section to the recording medium through a transfer current path from the opposite member to the contact section via the recording medium; and a selection section that selects the first control section or the second control section depending on a type of the recording medium.

BRIEF DESCRIPTION OF THE DRAWINGS

Exemplary embodiments of the present invention will be described in detail based on the following figures, wherein.

DETAILED DESCRIPTION

Outline of Exemplary Embodiment

Figure 1:
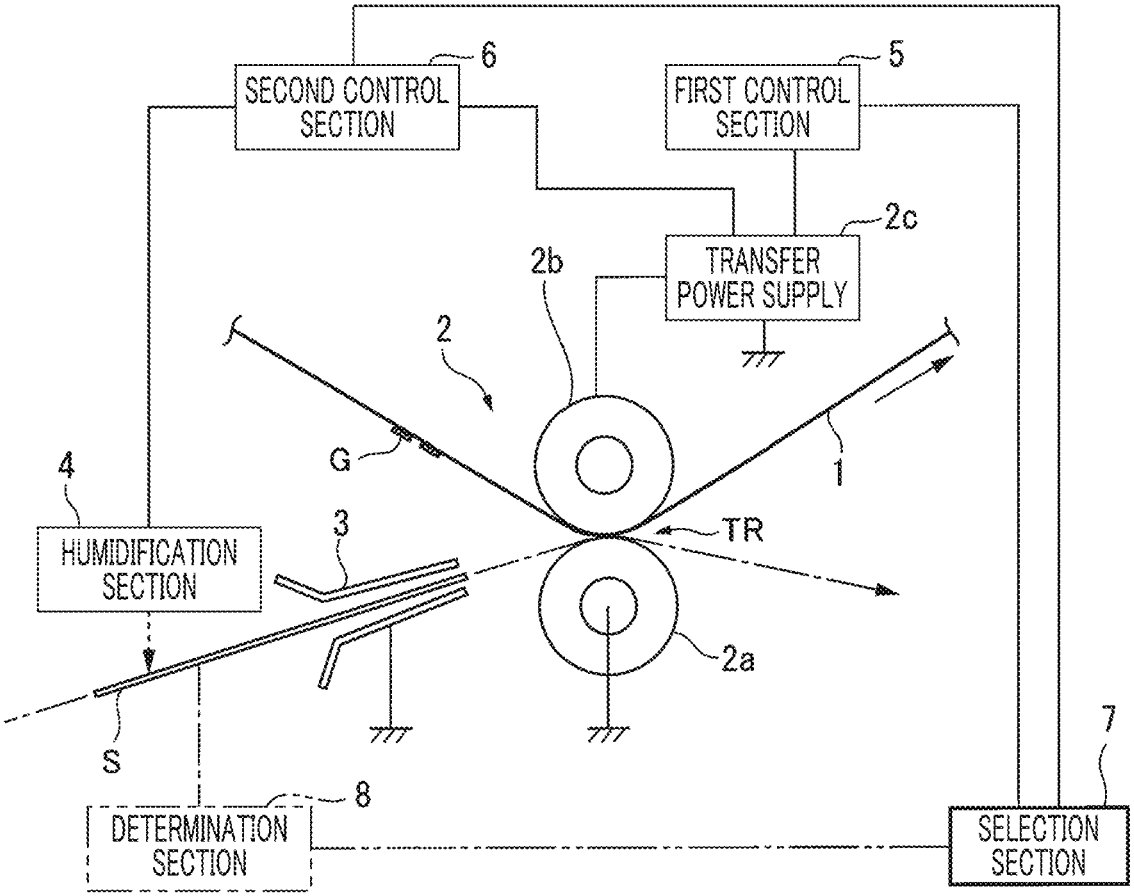
FIG. 1 is an explanatory diagram illustrating an outline of an exemplary embodiment of an image forming apparatus to which the present disclosure is applied.

FIG. 1 is an explanatory diagram illustrating an outline of an exemplary embodiment of an image forming apparatus to which the present disclosure is applied.

In FIG. 1, the image forming apparatus includes: an image holding section 1 which holds an image G; a transfer section 2 which includes a transfer member 2*a* disposed in contact with an image holding surface of the image holding section 1 and an opposite member 2*b* disposed at a position facing the transfer member 2*a* across the image holding section 1, connects a transfer power supply 2*c* to the opposite member 2*b* so as to apply a transfer electric-field to a transfer region TR between the image holding section 1 and the transfer member 2*a*, and electrostatically transfers the image G held by the image holding section 1 onto a recording medium S transported to the transfer region TR; contact sections 3 which are provided upstream and downstream of the recording medium S in the direction of transport of the recording medium S across the transfer region TR and acts as electrodes to ground while being in contact with the recording medium S when the recording medium S passes through the transfer region TR; a humidification section 4 which is provided upstream of the transfer region TR in the direction of transport of the recording medium S and humidifies the recording medium S; a first control section 5 which performs control to transfer the image G on the image holding section 1 to the recording medium S without humidification by the humidification section 4; a second control section 6 which performs control to cause the humidification section 4 to humidify the recording medium S, to transport the humidified recording medium S to the transfer region TR, and to transfer the image G on the image holding section 1 to the recording medium S through a transfer current path from the opposite member 2*b* to the contact section 3 via the recording medium S; and a selection section 7 which selects the first control section 5 or the second control section 6 depending on the type of the recording medium S.

In such a technical section, the image holding section 1 is not limited to an intermediate transfer body of an intermediate transfer method, but includes a photosensitive member in a direct transfer method and a dielectric.

In addition, the transfer section 2 may include the transfer member 2*a*, the opposite member 2*b*, and the transfer power supply 2*c*, but in a mode of connecting the transfer power supply 2*c* to the transfer member 2*a*, a transfer operation to a low-resistance recording medium cannot be performed, so that the mode is excluded.

Further, as long as the contact section 3 is to be grounded other than in a mode of not being grounded (float), the contact section 3 also widely includes direct grounding, resistance grounding, and bias grounding.

Furthermore, the humidification section 4 may be provided in an accommodation section of the recording medium S, or may be provided in the transport path of the recording medium S.

In addition, the first control section 5 is not limited to a transfer method (an opposite transfer method) by the transfer current path between the opposite member 2*b* and the transfer member 2*a* and a creeping transfer method (a method in which a transfer current flows along a surface of the recording medium S) not including humidification for a low resistance recording medium, and a transfer method not including humidification by the humidification section 4 is widely included.

On the other hand, the second control section 6 performs a transfer operation so as not to cause abnormal discharge on a recording medium with low transferability, in particular, rough paper such as Japanese paper and a cardboard (discharge at internal fiber cavity) or special high-resistance paper (discharge at carbon black aggregation portion) such as black paper, or the like, and a humidification+creeping transfer method is adopted. Meanwhile, a recording medium other than the recording medium with low transferability described above may include a mode of the humidification+creeping transfer method.

According to the present exemplary embodiment having such a configuration, even in a case where the recording medium S passing through the transfer region TR has a low transferability type, the creeping transfer method can be adopted via a humidification process by the humidification section 4, so that it is possible to keep the transfer electric-field in the transfer region TR within an appropriate range of the transfer electric-field, that is, a range necessary to appropriately perform the transfer operation.

Next, a representative embodiment or an exemplary embodiment of the image forming apparatus according to the present exemplary embodiment will be described.

A representative embodiment of the second control section 6 includes a mode in which constant current control is performed on the transfer electric-field by the transfer section 2. The present example is appropriate in that the transfer electric-field can be easily maintained within an appropriate range, as compared with a constant voltage control mode.

Here, in adopting a constant current control method, a setting current of the transfer electric-field by the transfer section 2 may be made different depending on whether the image G held by the image holding section 1 is a monochromatic image or a multicolor image. In the present example, the setting current of the constant current control is made different depending on the image type, specifically, in a case of the multicolor image, the transfer current is set larger than in a case of the monochromatic image, so that a large transfer electric-field is obtained.

Further, as a representative embodiment of the selection section 7, a determination section 8 capable of determining a type of the recording medium S transported toward the transfer region TR is provided, and the selection section 7 selects the first control section 5 or the second control section 6 based on a result of determination by the determination section 8. In the present example, the first control section 5 or the second control section 6 is selected based on the result of determination by the determination section 8 which determines the type of the recording medium S.

Here, examples of criteria for selecting the second control section 6 include the following. (1) The second control section 6 is selected when the recording medium S has a high resistance equal to or higher than a predetermined resistance value. (2) The second control section 6 is selected when the recording medium S has a high resistance equal to or higher than a predetermined resistance value and includes a medium base containing a conductive agent. (3) The second control section 6 is selected when the recording medium S has a high resistance equal to or higher than a predetermined resistance value and is black. (4) The second control section 6 is selected when the recording medium S has a high resistance equal to or higher than a predetermined resistance value and includes a medium base containing carbon black. (5) The second control section 6 is selected when the recording medium S has a high resistance equal to or higher than a predetermined resistance value and the image G held by the image holding section 1 contains a planar background image formed with an opaque background image-forming agent.

In addition, a representative embodiment of the first control section 5 includes control of transferring the image G on the image holding section 1 to the recording medium S by the transfer current path from the opposite member 2*b* to the transfer member 2*a*. In the present example, in the mode in which the transfer current path from the opposite member 2*b* to the transfer member 2*a* is used, and even in a case where the constant voltage control method is adopted in the transfer region for the recording medium S with appropriate transferability, it is possible to keep the transfer electric-field within an appropriate range. Meanwhile, in a case of a low resistance recording medium having a resistance value not more than a predetermined value, the transfer current easily flows along the surface of the recording medium S, so that the constant current control method in the transfer region for this type of low resistance recording medium may be adopted.

In addition, in a case where opposite transfer method is adopted as the first control section 5, as an exemplary embodiment of the second control section 6, when the first control section 5 is selected, the transfer member 2*a* is grounded directly or with a low resistance equal to or less than a predetermined resistance value, and when the second control section 6 is selected, the transfer member 2*a* is grounded with a high resistance equal to or higher than the predetermined resistance value. In the present example, when the second control section 6 is selected, a part of the transfer current does not easily flow through a side of the transfer member 2*a*.

In addition, another exemplary embodiment of the first control section 5 includes control of transferring the image G on the image holding section 1 to the recording medium S by a transfer current path from the opposite member 2*b* to the contact section 3 via the recording medium S. In the present example, as still another exemplary embodiment of the first control section 5, a low-resistance recording medium (a medium having a resistance value equal to or less than a predetermined resistance value or a medium having a conductive layer along a medium base surface) does not require a humidification process, and a transfer current path from the opposite member 2*b* to the contact section 3 via the recording medium S is adopted.

As an example of humidification by the humidification section 4 on the recording medium S, an image holding surface of the recording medium S is humidified. In the present example, in adopting the creeping transfer method, from the viewpoint of stably securing a transfer current path along the recording medium S, that is, always securing a portion with a low surface resistance to be the transfer current path on the surface of the recording medium S, the image holding surface of the recording medium S may be directly humidified and the resistivity of the image holding surface of the recording medium S may be reduced so as to facilitate the transfer current.

As another example of humidification, a surface (a non-image holding surface) opposite to the image holding surface of the recording medium S may be humidified so as to allow a humidifying material to permeate the image holding surface, or both of the image holding surface and the non-image holding surface of the recording medium S may be humidified.

Further, as an exemplary embodiment of the humidification section 4, from the viewpoint of enabling the humidification process to be individually performed on the recording medium S, the humidification section 4 is provided in the middle of a transport path of the recording medium S transported from the accommodation section in which the recording medium S is stored.

Hereinafter, the present disclosure will be described in detail based on the exemplary embodiments illustrated in accompanying drawings.

Exemplary Embodiment 1

Figure 2:
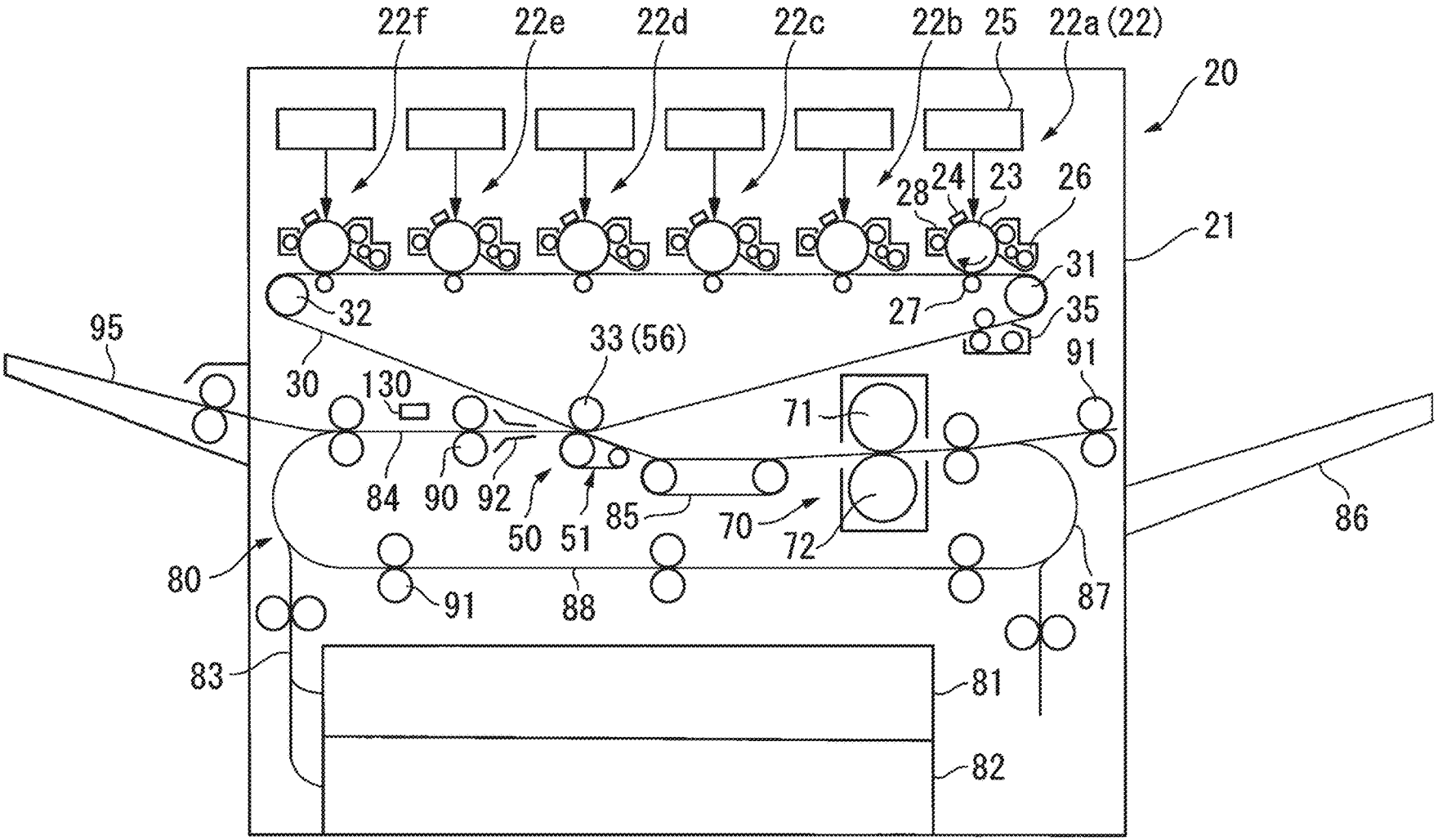
FIG. 2 is an explanatory diagram illustrating an overall configuration of an image forming apparatus according to Exemplary Embodiment 1.

FIG. 2 is an explanatory diagram illustrating an overall configuration of the image forming apparatus according to Exemplary Embodiment 1.

Overall Configuration of Image Forming Apparatus

In FIG. 2, an image forming apparatus 20 includes an image forming unit 22 (specifically, 22a to 22*f*) which forms an image having plural color components (white #1, yellow, magenta, cyan, black, and white #2 in the present exemplary embodiment), a belt-shaped intermediate transfer body 30 which sequentially transfers (primarily transfers) and holds each color component image formed by each image forming unit 22, a secondary transfer device (collective transfer device) 50 which secondarily transfers (collectively transfers) each color component image transferred onto the intermediate transfer body 30 onto a piece of paper S (see FIG. 3) as a recording medium, a fixing device 70 which fixes the secondarily transferred image on the paper S, and a paper transport system 80 which transports the paper S to the secondary transfer region, in an image forming apparatus housing 21. In the present example, white #1 and white #2 use the same white material, but different materials may be used depending on whether positions of white #1 and white #2 are at a lower layer or an upper layer than the other color component images on the paper S. In addition, for example, a transparent material may be used instead of one white #1.

Image Forming Unit

In the present exemplary embodiment, each of the image forming units 22 (22*a* to 22*f*) includes a drum-shaped photosensitive member 23, a charging device 24 such as a corotron, a transfer roll, or the like, which charges the photosensitive member 23, in a periphery of each photosensitive member 23, an exposure device 25 such as a laser scanning device or the like in which an electrostatic latent image is written on the charged photosensitive member 23, a developing device 26 which develops the electrostatic latent image written on the photosensitive member 23 by each color component toner, a primary transfer device 27 such as a transfer roll or the like in which a toner image on the photosensitive member 23 is transferred to the intermediate transfer body 30, and a photoconductor cleaning device 28 which removes a residual toner on photosensitive member 23.

In addition, the intermediate transfer body 30 is stretched over plural (three in the present exemplary embodiment) tension rolls 31 to 33, for example, the tension roll 31 is used as a driving roll driven by a drive motor (not illustrated), and is circulated and moved by the driving roll. Further, an intermediate transfer body cleaning device 35 which removes a residual toner on the intermediate transfer body 30 after a secondary transfer is provided between the tension rolls 31 and 33.

Secondary Transfer Device (Collective Transfer Device)

Figure 3:
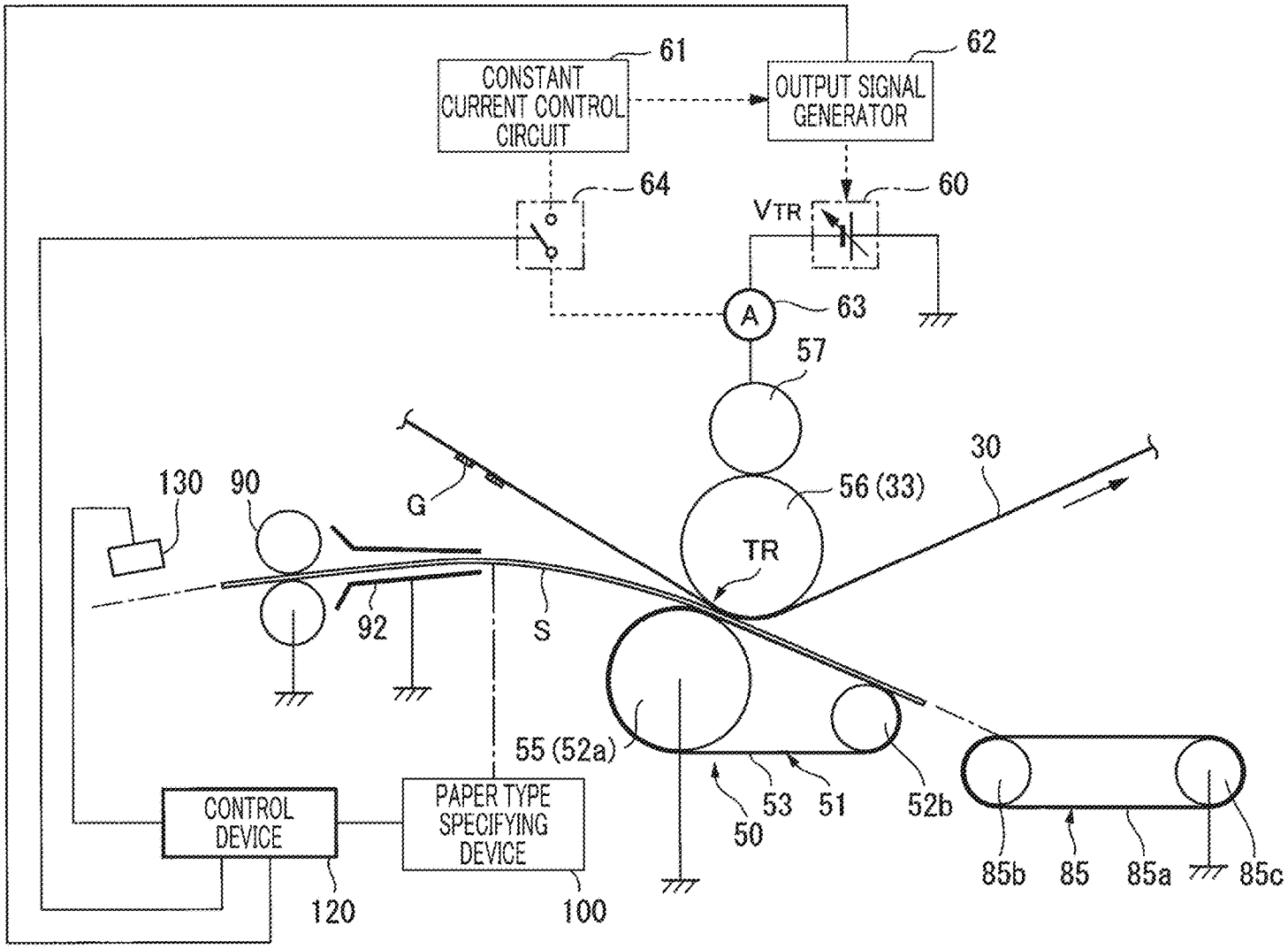
FIG. 3 is an explanatory diagram illustrating details of a configuration on a periphery of a secondary transfer unit according to Exemplary Embodiment 1.

Further, as illustrated in FIGS. 2 and 3, in the secondary transfer device (collective transfer device) 50, a stretched belt transfer module 51 in which a transfer transport belt 53 is stretched on plural (for example, two) tension rolls 52 (specifically, 52*a* and 52*b*), is disposed to be in contact with a surface of the intermediate transfer body 30. The belt transfer module 51 is retractably supported by a retraction mechanism (not illustrated), and can be brought into contact with or separated from the intermediate transfer body 30.

Here, the transfer transport belt 53 is a semiconductive belt having a volume resistivity of $10^6$ to $10^{12}$ Ω·cm using a material such as chloroprene or the like, one tension roll 52*a* is configured as an elastic transfer roll 55, this elastic transfer roll 55 is press-contacted on the intermediate transfer body 30 via the transfer transport belt 53 in the secondary transfer region (collective transfer region) TR, the tension roll 33 of the intermediate transfer body 30 is disposed opposite to a facing roll 56 serving as a counter electrode of the elastic transfer roll 55, and a transporting path of the paper S is formed from a position of one tension roll 52*a* to a position of the other tension roll 52*b*.

In addition, in the present example, the elastic transfer roll 55 has a structure in which an elastic layer in which carbon black or the like is blended with foamed urethane rubber or EPDM is coated around a metal shaft. In the present example, all of the tension rolls 52 (52*a* and 52*b*) of the belt transfer module 51 are grounded, so that the transfer transport belt 53 is prevented from being charged. In addition, in view of detachability of the paper S at a downstream end of the transfer transport belt 53, it is effective to allow the downstream tension roll 52*b* to function as a peeling roll having a smaller diameter than the upstream tension roll 52*a*.

Further, a transfer voltage $V_{TR}$ from a transfer power supply 60 is applied to the facing roll 56 (also used as the tension roll 33 in the present example) via a conductive power supply roll 57, and a predetermined transfer electric-field is formed between the elastic transfer roll 55 and the facing roll 56.

In the present example, the secondary transfer device 50 uses the belt transfer module 51, but the present example is not limited thereto. The present example may have a mode in which the elastic transfer roll 55 is disposed to be in direct pressure contact with the intermediate transfer body 30.

Fixing Device

As illustrated in FIG. 2, the fixing device 70 includes a driving rotatable heating fixing roll 71 which is disposed in contact with the image holding surface of the paper S and a pressure fixing roll 72 which is disposed in pressure contact with the heating fixing roll 71 and rotates to follow the heating fixing roll 71, and passes an image held on the paper S into the transfer region between the fixing rolls 71 and 72, and heats and pressure-fixes the image.

Paper Transport System

Further, as illustrated in FIGS. 2 and 3, the paper transport system 80 includes plural (two in the present example) paper supply containers 81 and 82, and the paper S supplied from any one of the paper supply containers 81 and 82 moves from a vertical transporting path 83 extending in an approximately vertical direction and reaches the secondary transfer region TR via a horizontal transporting path 84 extending in an approximately horizontal direction. After then, the paper S in which the transferred image is held reaches a fixing portion by the fixing device 70 via a transport belt 85 and is discharged to a paper exit receiver 86 provided on a side of the image forming apparatus housing 21.

Furthermore, the paper transport system 80 includes a reversible branch transporting path 87 branched downward from a portion of the horizontal transporting path 84 located downstream of the fixing device 70 in the paper transport direction, the paper S reversed at the branch transporting path 87 is returned again from the vertical transporting path 83 to the horizontal transporting path 84 via a transporting path 88, and the image is transferred to a rear surface of the paper S in the secondary transfer region TR, and the paper S is discharged to the paper exit receiver 86 via the fixing device 70.

In addition, in the paper transport system 80, in addition to an aligning roll 90 which aligns the paper S and supplies the paper S to the secondary transfer region TR, an appropriate number of transport rolls 91 is provided in each of the transporting paths 83, 84, 87, and 88.

Furthermore, on an opposite side of the paper exit receiver 86 of the image forming apparatus housing 21, a manual paper feeding device 95 capable of manually feeding a piece of paper toward the horizontal transporting path 84 is provided.

Guide Chute

Further, a guide chute 92 which guides the paper S passing through the aligning roll 90 to the secondary transfer region TR is provided on an inlet side of the secondary transfer region TR of the horizontal transporting path 84. In the present example, the guide chute 92 arranges a pair of metal plates such as SUS or the like in a predetermined inclined posture, and restricts a rush posture of the paper S rushing into the secondary transfer region TR, and is directly grounded. In the present example, one guide chute 92 is illustrated between the aligning roll 90 and the secondary transfer region TR, but it is not necessary to be one, and plural guide chutes 92 may be provided.

Contact Member with Paper Located Before and after Secondary Transfer Region

In the present exemplary embodiment, as a contact member with the paper S located before and after the secondary transfer region TR, as illustrated in FIGS. 2 and 3, the guide chute 92 and the aligning roll 90 are provided on the inlet side of the secondary transfer region TR, and the transport belt 85 is provided on an outlet side of the secondary transfer region TR.

In the present example, the aligning roll 90 is formed of a metal roll member, the guide chute 92 is formed of a metal chute member, and both of the aligning roll 90 and the guide chute 92 are directly grounded.

In the present example, although both of the aligning roll 90 and the guide chute 92 are directly grounded, the present example is not limited thereto. A resistance grounding method of grounding via a resistance may be adopted. However, as the resistance used in the resistance grounding method, a resistance lower than a resistance value (for example, a volume resistivity) of the highest resistance element (for example, the elastic transfer roll 55) may be selected among components of the belt transfer module 51.

In addition, in the present example, the transport belt 85 stretches a belt member 85*a* made of, for example, conductive rubber with a pair of tension rolls 85*b* and 85*c*, and at least one tension roll of the tension rolls 85*b* and 85*c* is configured to include a metal roll, a conductive resin, or a combination thereof, and a core metal is directly grounded.

Further, in the present exemplary embodiment, a paper transporting path length between the guide chute 92 and the transport belt 85, which are contact members of the paper S located closest to the inlet side and the outlet side across the secondary transfer region TR, may be appropriately selected. Meanwhile, at least in the transport process in which the paper S passes through the secondary transfer region TR, an operation in which the paper S is disposed in a state of being straddled between the secondary transfer region TR and the guide chute 92 or the transport belt 85 is illustrated.

Paper Type

An example of the paper S which can be used in the present example widely includes a range of paper with a low surface resistance to a high resistance.

For example, in an image forming apparatus including an image forming mode (for example, an undercoating image forming mode) of producing a background image (for example, a white image) on a surface of a piece of paper and producing colored images of various color components on the background image, in a case where multiple images of the background image and the colored image are transferred to a piece of paper (high resistance and low density) having low transferability, there is a technical problem that a transfer failure occurs. An examination of this factor revealed that the factor is a discharge generated during transfer.

Specifically, the paper used in the undercoating image forming mode is, for example, black paper. In a case where this type of black paper is examined, no transfer failure is observed for black paper having a low surface resistance, but a transfer failure is observed for black paper having a high surface resistance exceeding 10 logo. Although white plain paper and the like also have a high surface resistance exceeding 10 logo, there is little need to produce a background layer by a background image for this type of plain paper originally, so that the technical problem of the transfer failure described above is not particularly regarded as a problem, and there is a new technical problem when using a special paper such as black paper having a high surface resistance.

Therefore, as a measure for the transfer failure in black paper or the like of 11 logΩ or more, as illustrated in FIG. 3, the present exemplary embodiment provides a paper type specifying device 100 which specifies a type of paper so as to determinate whether or not the paper is paper which requires the measure.

Paper Type Specifying Device

Figure 4A:
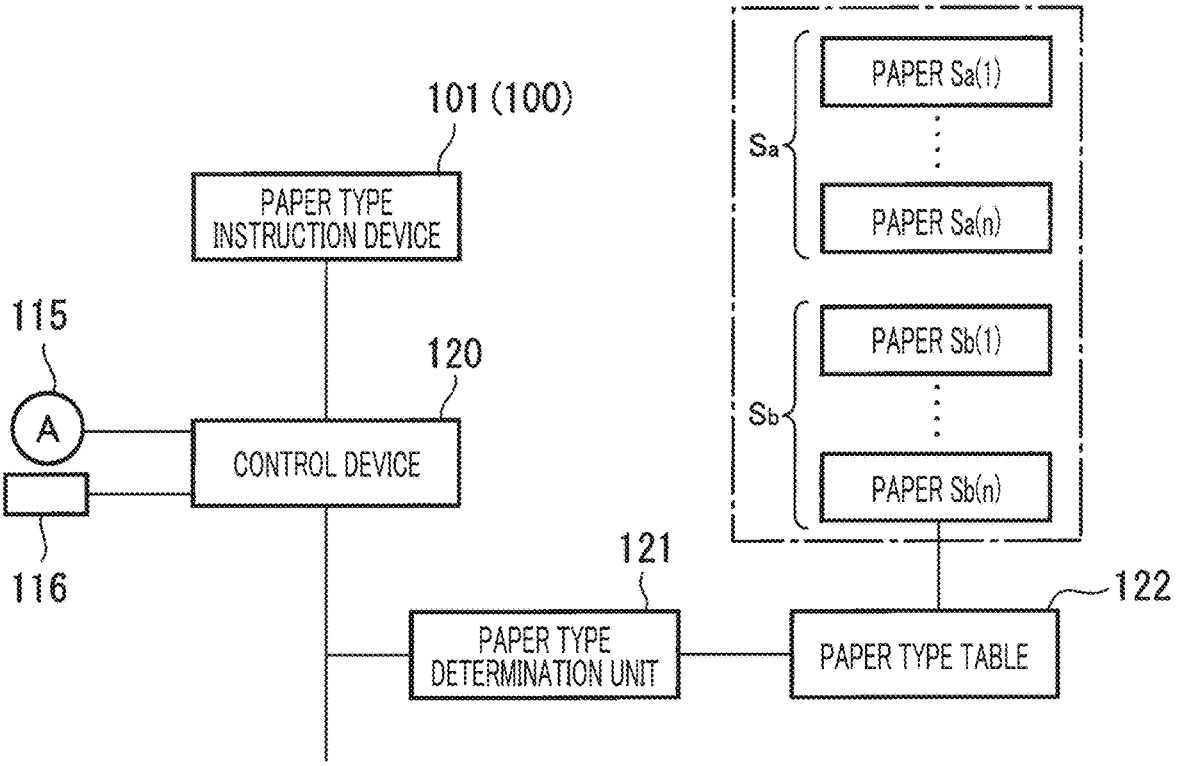
FIG. 4A is an explanatory diagram illustrating an example of a process of determining a paper type based on information from a paper type specifying device.

In the present exemplary embodiment, as illustrated in FIG. 4A, the paper type specifying device 100 includes, for example, a paper type instruction device 101 in an operation panel as a user interface, and registers types of the paper S usable in the image forming apparatus 20 so as to instruct a paper type to be used among the types.

Figure 4B:
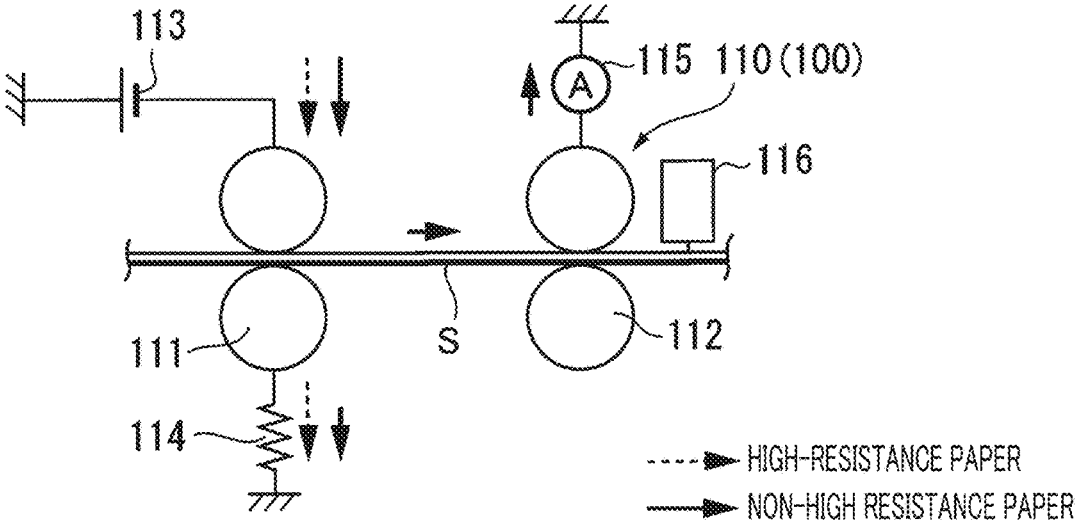
FIG. 4B is an explanatory diagram illustrating an example of the paper type specifying device.

Further, as illustrated in FIGS. 2 and 4B, for example, as the paper type specifying device 100, a measurement device 110 is provided to measure a paper type in a part of the vertical transporting path 83 or the horizontal transporting path 84 of the paper transport system 80.

In the measurement device 110, pairing determination rolls 111 and 112 are arranged in parallel along the direction of transport of the paper S, and one determination roll 111 located upstream in the direction of transport of the paper S is connected to a determination power supply 113 and the other is grounded via a resistor 114. An ammeter 115 is provided between the ground and one determination roll 112 located downstream in the direction of transport of the paper S. As the determination rolls 111 and 112, a transport member (the aligning roll 90 and the transport roll 91) of the paper S also may be used, or may be provided separately from the transport member.

In the present example, for example, assuming that a non-high resistance paper of 10 logΩ/square or less is used as the paper S, in a case where the non-high resistance paper is disposed to be straddled between the pairing determination rolls 111 and 112, a determination current from the determination power supply 113 is divided into a component which flows across the pairing determination roll 111 and a component which travels along the paper S and reaches the ammeter 115 on the determination roll 112 side.

On the other hand, assuming that a high resistance paper having a surface resistance of 11 log Ω/square or more is used as the paper S, since a surface resistance of the high-resistance paper is larger than that of the non-high resistance paper, in a case where the high-resistance paper is disposed to be straddled between the pairing determination rolls 111 and 112, a determination current from the determination power supply 113 is reduced by impedance and flows so as to cross the pairing determination roll 111, but hardly reaches the ammeter 115 on the determination roll 112 side along the paper S. As a result, a surface resistance of the paper S is calculated by a measurement current measured by the ammeter 115 and a voltage applied by the determination power supply 113, and a paper type is determined.

Further, in the present example, the measurement device 110 can detect whether or not the transported paper S is black by an output change of an optical sensor 116 (for example, a sensor having a method of emitting light from a light emitting element to a surface of paper and receiving a reflected light by a light receiving element).

Humidifier

In the present exemplary embodiment, as illustrated in FIG. 3, a humidifier 130 is installed upstream of the aligning roll 90 in the direction of transport of the paper S. In the present example, the humidifier 130 is disposed to face the image holding surface of the transported paper S, and directly humidifies the image holding surface of the paper S.

Figure 5A:
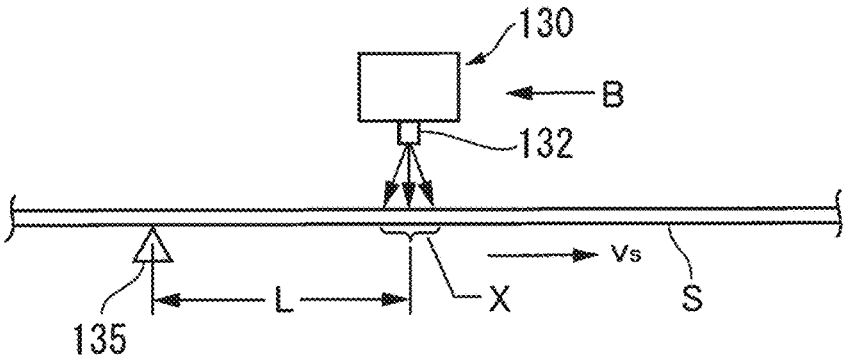
FIG. 5A is an explanatory diagram illustrating a humidifier used in Exemplary Embodiment 1.
Figure 5B:
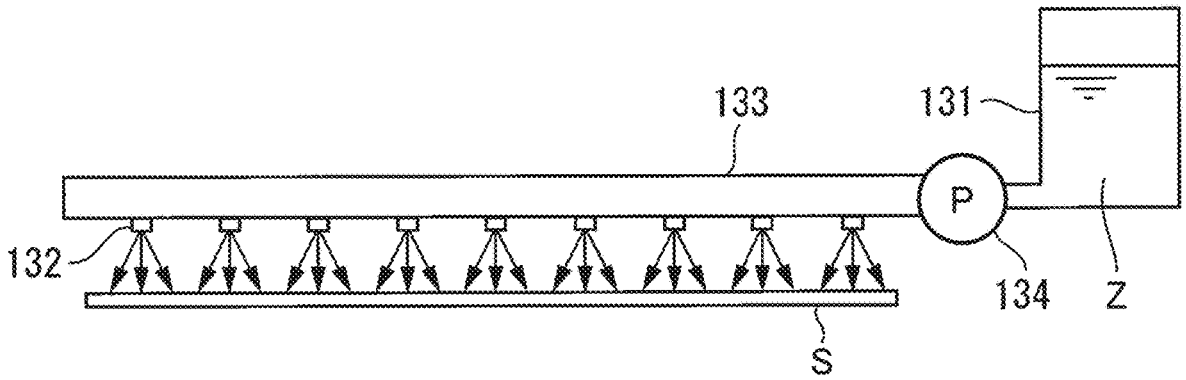
FIG. 5B is an arrow view as seen from a B direction in FIG. 5A.

Here, for example, as illustrated in FIGS. 5A and 5B, the humidifier 130 includes a tank 131 in which water as a humidifying material Z is stored, and the paper S facing the image holding surface of the paper S. a spray multi-nozzle 132 which is disposed approximately equally along a width direction facing the image holding surface of the paper S and intersecting the paper S in the transport direction, a connection pipe 133 which connects the tank 131 and the spray multi-nozzle 132 so as to communicate with each other, and a pump 134 which is provided at a part of the connection pipe 133 and delivers water as the humidifying material Z to the spray multi-nozzle 132 at a predetermined pressure. Specifically, in the present example, distilled water mixed with a surfactant is used as water as the humidifying material Z so that the spray multi-nozzle 132 is not clogged.

In the present example, based on a control signal from the control device 120, the humidifier 130 continues an operation on the paper S requiring the humidification process while the paper S passes through a humidification region X and the operation is controlled to be stopped at a stage in which the paper S passes and leaves the humidification region X, and mist-like water as the humidifying material Z is sprayed onto approximately the entire region of the image holding surface of the paper S. In addition, it is also possible to control the spray amount of water as the humidifying material Z by adjusting pressure by the pump 134.

For example, a timing when the paper S passes through the humidification region X is detected by a position sensor 135 provided in a part of a transport path detecting a timing when a tip end and a rear end of the paper S in the transport direction pass and by calculating a timing when the tip end of the paper S reaches the humidification region X and a timing when the rear end leaves the humidification region X based on a distance L between the position sensor 135 and the humidification region X and a transport speed vs of the paper S.

Further, in the present example, although the spray multi-nozzle 132 is used as the humidifier 130, the present example is not limited to this. For example, by using an ink jet head used by an ink jet printer, water as the humidification material Z may be injected. At this time, the ink jet head may be disposed over the entire region of the paper S in a width direction, or may be disposed to be divided into plural parts. In a case of using the ink jet head, it is also possible to control the amount of injected water (droplet amount or the number of droplets) by controlling the ink jet head.

Figure 5C:
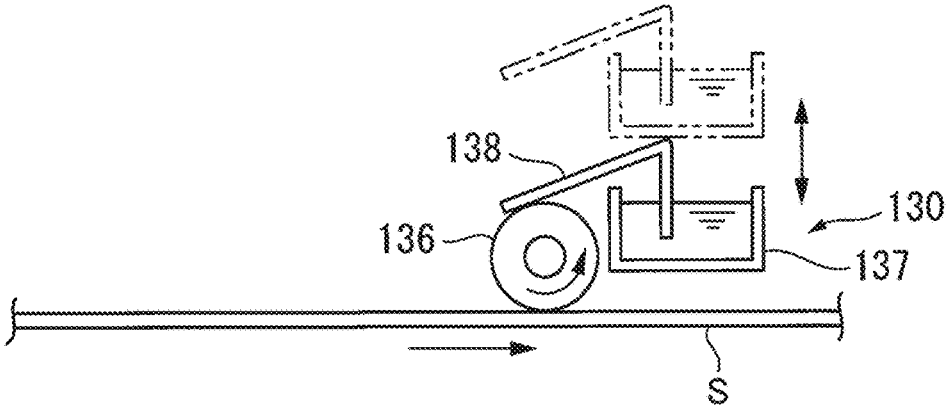
FIG. 5C is an explanatory diagram illustrating another humidifier.

In addition, as illustrated in FIG. 5C, as another example of the humidifier 130, an application roll 136 capable of contacting the image holding surface of the paper S is provided, a tank 137 in which water as the humidifying material Z is stored is disposed near the application roll 136, an absorption member 138 made of, for example, a felt material, which is soaked and impregnated in water as the humidifying material Z, is provided in the tank 137, water as the humidifying material Z is supplied to a surface of the application roll 136 by bringing a part of the absorption member 138 into contact with the application roll 136, the application roll 136 is rotated following the transport of the paper S, and the image holding surface of the paper S is applied with the water as the humidifying material Z.

In the present example, water as the humidifying material Z is directly applied to the image holding surface of the paper S. Meanwhile, in a case where the humidifier 130 does not perform the humidification, the tank 137 and the absorption member 138 are lifted by a lifting mechanism (not illustrated) and the supply of water as the humidifying material Z to the application roll 136 is stopped by dispositioning the application roll 136 and the absorption member 138 in a non-contact manner.

Relationship between Paper Type and Transfer Current Path

High-Resistance Paper

Figure 6A:
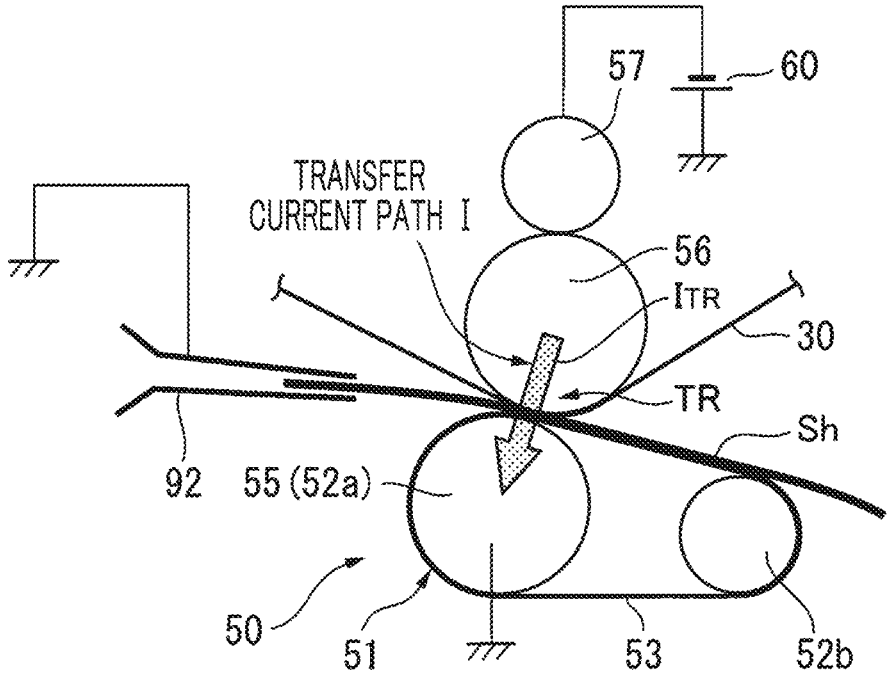
FIG. 6A is an explanatory diagram illustrating a transfer current path flowing in a case where a piece of high-resistance paper is used in the image forming apparatus according to Exemplary Embodiment 1.

Assuming that a piece of high-resistance paper Sh (for example, the paper S of 11 logΩ·cm or more is used in the present example) rushes into the secondary transfer region TR, as illustrated in FIG. 6A, the high-resistance paper Sh reaches the secondary transfer region TR via the guide chute 92. The image G on the intermediate transfer body 30 is transferred to the high-resistance paper Sh in the secondary transfer region TR. At this time, even in a case where the high-resistance paper Sh is in contact with the guide chute 92 while the high-resistance paper Sh passes through the secondary transfer region TR, since a surface resistance of the high-resistance paper Sh is high to some extent, a part of a transfer current $I_{TR}$ in the secondary transfer region TR does not leak through a conduction path leading to a ground of the guide chute 92 with the high-resistance paper Sh as the conduction path. Therefore, the transfer current $I_{TR}$ in the secondary transfer region TR flows through a side of the facing roll 56, the intermediate transfer body 30, the high-resistance paper Sh, and the belt transfer module 51. A system resistance of a transfer current path I in this case is a total of the facing roll 56, the intermediate transfer body 30, the high-resistance paper Sh, and the belt transfer module 51.

Low Resistance Paper

Figure 6B:
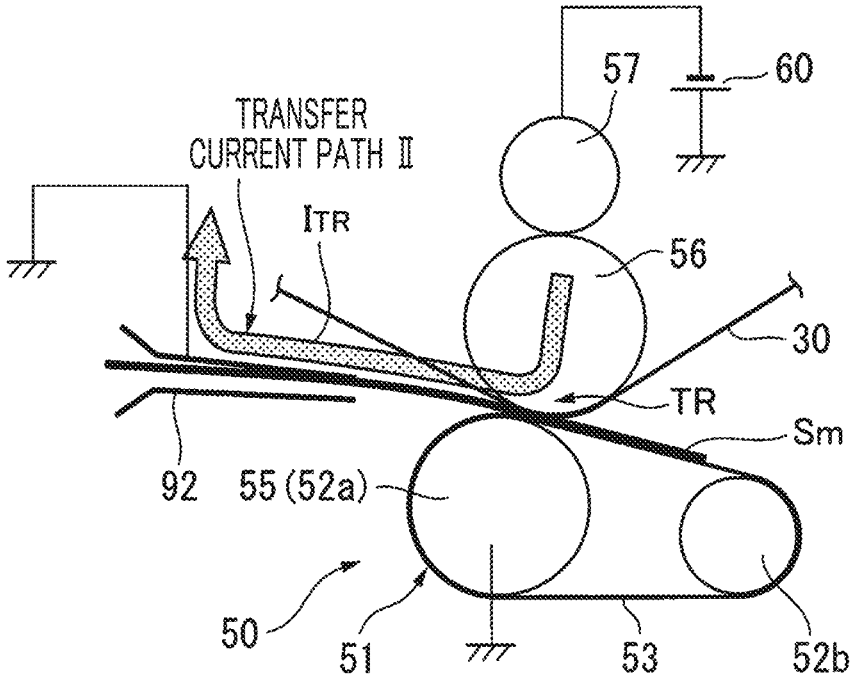
FIG. 6B is an explanatory diagram illustrating a transfer current path flowing in a case where a piece of low-resistance paper is used by the image forming apparatus.

On the other hand, assuming that among pieces of non-high resistance paper not belonging to the high-resistance paper Sh, a piece of low-resistance paper Sm such as specifically metallic paper or low-resistance black paper (for example, the paper S of 7 logΩ·cm or less is used in the present example) rushes into the secondary transfer region TR, as illustrated in FIG. 6B, the low-resistance paper Sm reaches the secondary transfer region TR via the guide chute 92. Here, in order to keep the low resistance paper Sm passing through the secondary transfer region TR in contact with the grounded guide chute 92, after passing through the facing roll 56 and the intermediate transfer body 30, the transfer current $I_{TR}$ in the secondary transfer region TR flows from the guide chute 92 to the ground as a conduction path of the low resistance paper Sm. Since resistance values of the guide chute 92 and the low resistance paper Sm are low, a system resistance of a transfer current path II in this case is mostly a sum of the facing roll 56 and the intermediate transfer body 30.

Configuration Example of Transfer Power Supply

As a transfer control method by the transfer power supply 60, there are a constant voltage control method and a constant current control method. The constant voltage control method is robust (strength against disturbance) to an image density fluctuation but weak to paper type fluctuation. The constant current control method is robust to the paper type fluctuation but weak to the image density fluctuation. Since a paper type can be handled by preparing a transfer voltage table in advance, in general, the constant voltage control system is adopted, in many cases.

In the present example, the transfer power supply 60 is configured to enable to select any of constant current control or constant voltage control. Specifically, as illustrated in FIG. 3, the transfer voltage $V_{TR}$ is variably set by the transfer power supply 60 based on a signal from an output signal generator 62, and a constant current control circuit 61 is connected to the output signal generator 62. In addition, an ammeter 63 for feedback is connected in series between the transfer power supply 60 and the power supply roll 57, a conduction path for feedback is provided between the ammeter 63 and the constant current control circuit 61, a selection switch 64 is provided in a middle of the conduction path for feedback, and whether to perform constant current control based on feedback is selected by an on/off operation of the selection switch 64. In a case of a condition that the selection switch 64 is turned on, a current value monitored by the ammeter 63 is fed back to the output signal generator 62 via the constant current control circuit 61, and the transfer voltage $V_{TR}$ of the transfer power supply 60 is variably set so that the transfer current Ix in the secondary transfer region TR becomes a constant current.

Figure 7A:
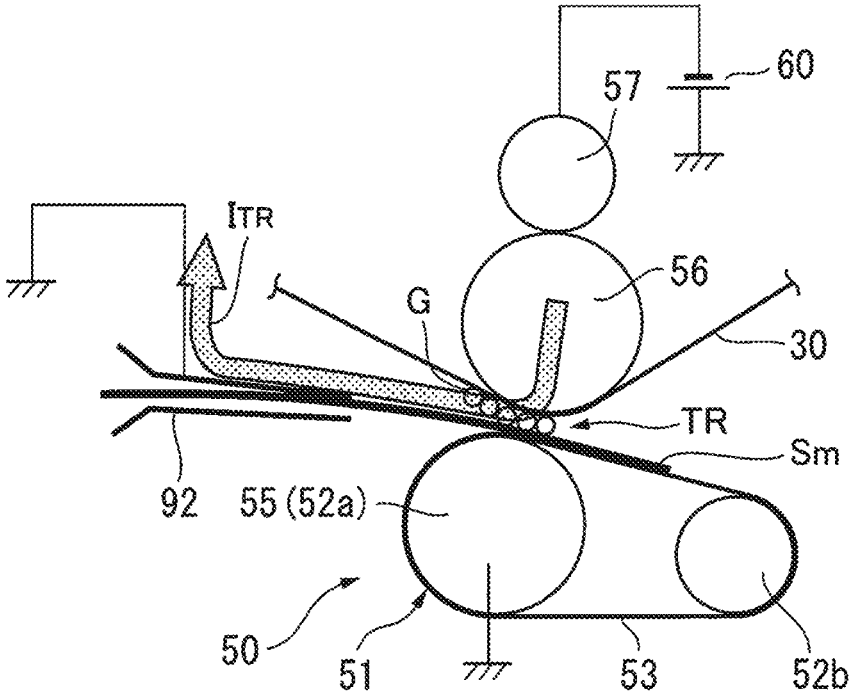
FIG. 7A is an explanatory diagram illustrating that a transfer operation by the transfer current path illustrated in FIG. 6B can be executed.

In the present example, as illustrated in FIG. 7A, since the transfer power supply 60 is connected to the facing roll 56 side, the transfer current $I_{TR}$ flows from a contact member such as the guide chute 92 or the like to the ground and from the intermediate transfer body 30 via the low resistance paper Sm. Since a transfer electric-field is formed between the intermediate transfer body 30 and the low resistance paper Sm, the image G by a toner on the intermediate transfer body 30 is transferred to the low resistance paper Sm side.

Figure 7B:
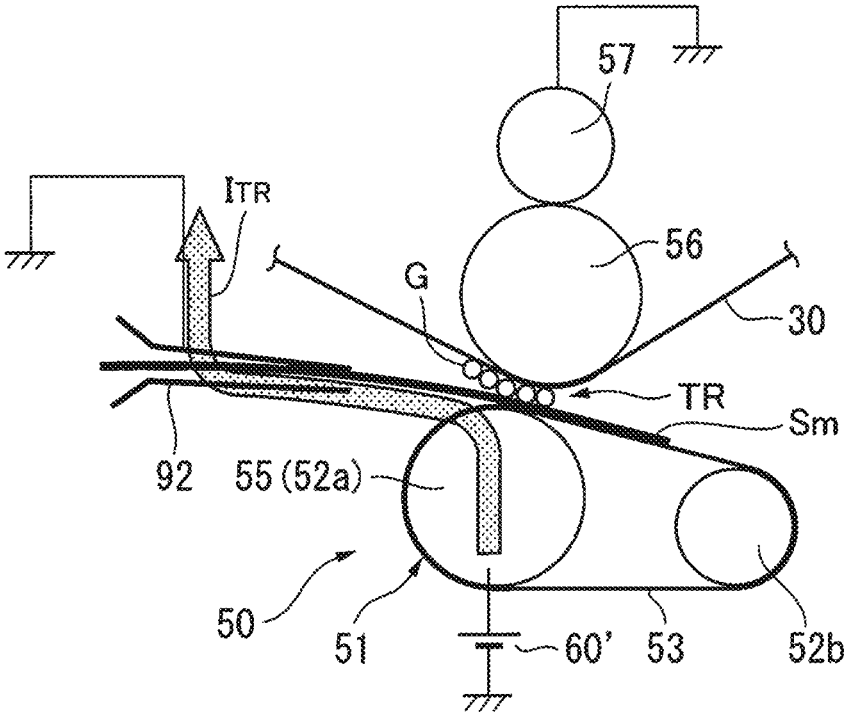
FIG. 7B is an explanatory diagram illustrating that a transfer operation by a secondary transfer unit according to a comparative embodiment cannot be executed.

However, as illustrated in FIG. 7B, in a case where a transfer power supply 60' is connected to the belt transfer module 51 side, the transfer current $I_{TR}$ flows from the contact member such as the guide chute 92 or the like to the ground and from the intermediate transfer body 30 via the low resistance paper Sm. Since the transfer electric-field is not applied between the intermediate transfer body 30 and the low resistance paper Sm, the image G by the toner on the intermediate transfer body 30 is not transferred to the low resistance paper Sm side. That is, the transfer power supply 60 needs to be connected to the facing roll 56 side so as to apply the transfer voltage $V_{TR}$.

Image Forming Mode

Figure 8A:
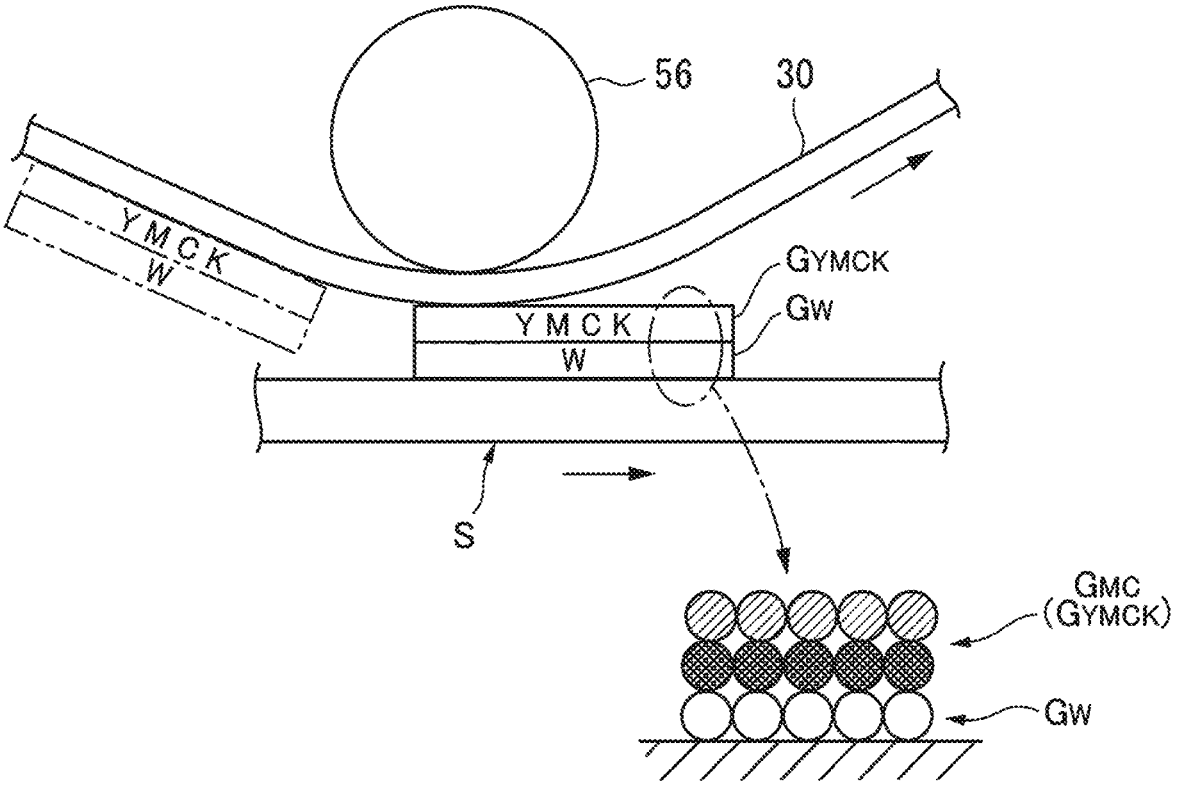
FIG. 8A is an explanatory diagram illustrating an example of forming a multicolor image on a piece of paper by the image forming apparatus according to Exemplary Embodiment 1.
Figure 8B:
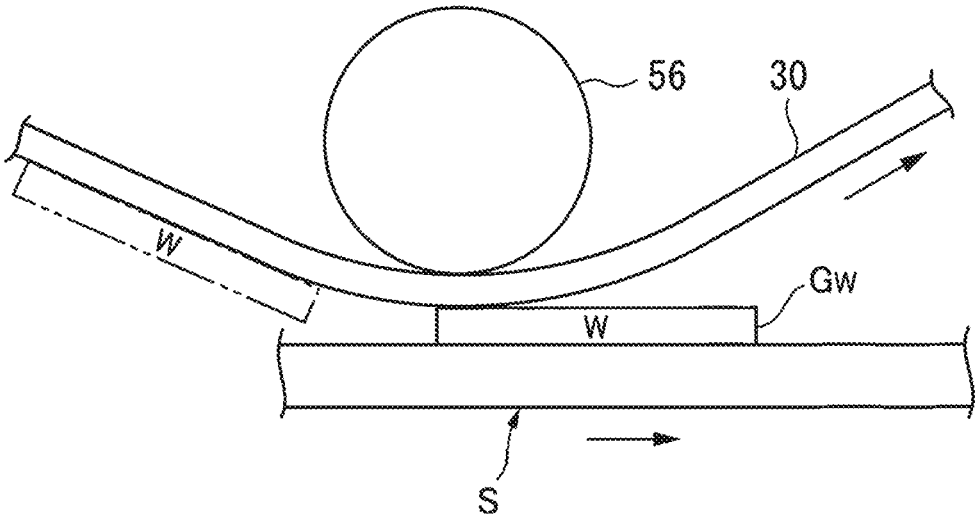
FIG. 8B is an explanatory diagram illustrating an example of forming a monochromatic image on a piece of paper by the image forming apparatus.

In the image forming apparatus of the present example, there are a multicolor mode illustrated in FIG. 8A and a monochrome mode illustrated in FIG. 8B as image forming modes.

In the multicolor mode, for example, in a case where black paper is used as the paper S, as illustrated in FIG. 8A, a color image $G_{YMCK}$ by YMCK using all or a part of the image forming units 22*b* to 22*e* illustrated in FIG. 2 and a color image $G_{MC}$ by MC using the image forming units 22*c* and 22*d* are formed on the intermediate transfer body 30, a white image Gw as a single color image by white W using the image forming unit 22*f* illustrated in FIG. 2 is formed on this color image $G_{MC}$ ($G_{YMCK}$), and the white image Gw and the color image $G_{MC}$ ($G_{YMCK}$) are collectively transferred onto the black paper as the paper S in the secondary transfer region TR.

On the other hand, in the monochrome mode, for example, in a case where black paper is used as the paper S, as illustrated in FIG. 8B, for example, the white image Gw is formed as a single color image by white W using the image forming unit 22*f* illustrated in FIG. 2, and the white image Gw is transferred onto black paper as the paper S in the secondary transfer region TR. In addition, instead of the white image Gw, for example, a monochromatic image may be formed by any color toner of YMC.

Driving Control System of Image Forming Apparatus

Figure 9:
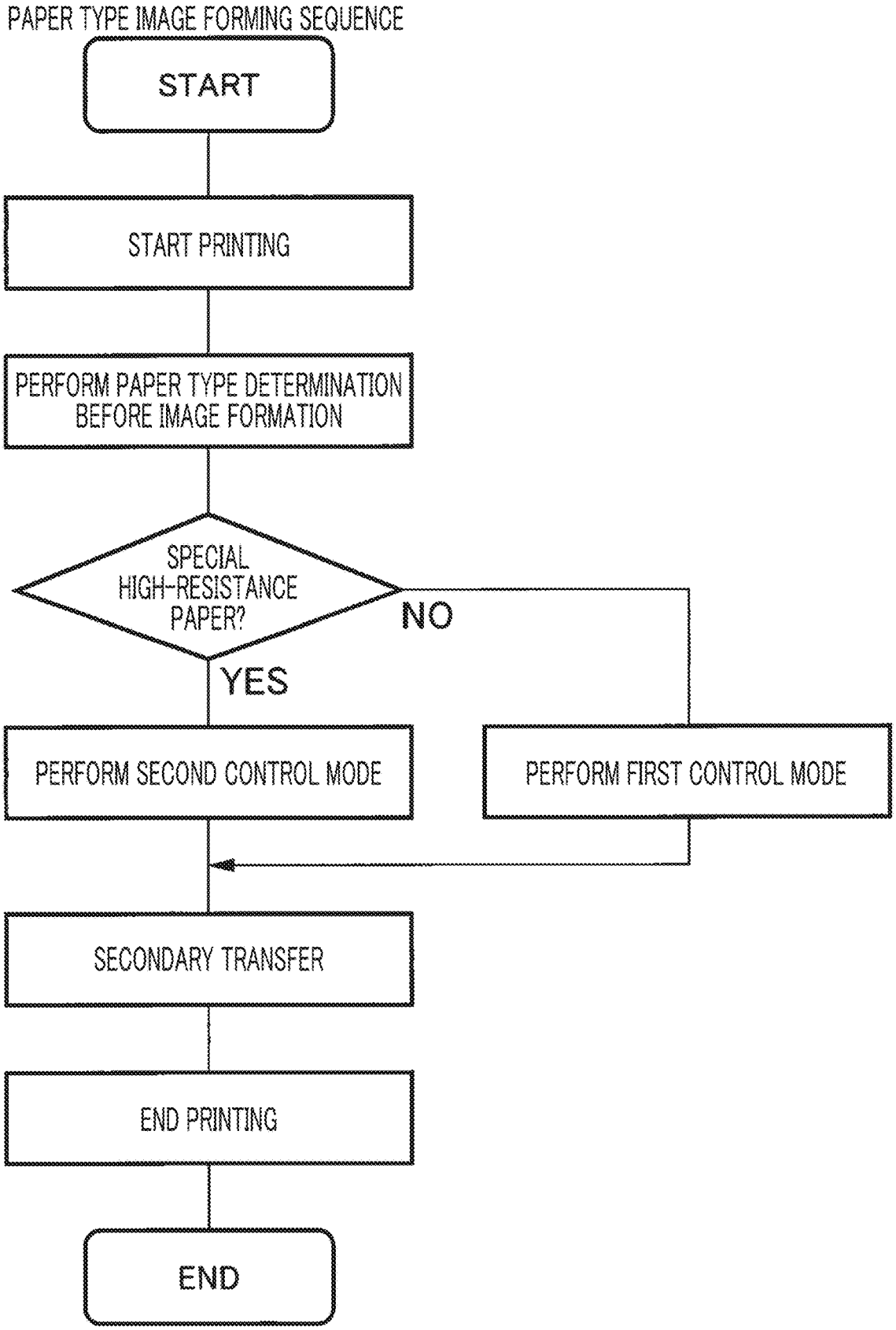
FIG. 9 is a flowchart illustrating a paper type image forming sequence used in the image forming apparatus according to Exemplary Embodiment 1.

In the present exemplary embodiment, as illustrated in FIG. 3, a reference numeral 120 is a control device which controls an image forming process of the image forming apparatus, and this control device 120 is a microcomputer including a CPU, a ROM, a RAM, and an input/output interface. The control device 120 obtains a switch signal such as a start switch (not illustrated), a mode selection switch for selecting an image forming mode, or the like via the input/output interface or various input signals, and various input signals such as a paper type specifying signal or the like from the paper type specifying device 100 which specifying a paper type, causes the CPU to execute an image forming control program (see FIG. 9) stored in advance in the ROM, generates a control signal for a driving control target, and transmits the control signal to each driving control target (the image forming unit 22 (22*a* to 22*f*), the transfer power supply 60, or the like).

Paper Type Determination Method

As illustrated in FIG. 4A, in a paper type determination method adopted in the present exemplary embodiment, the control device 120 obtains information for specifying the paper S from the paper type specifying device 100 (the paper type instruction device 101, the ammeter 115 of the measurement device 110, and the optical sensor 116), and the paper type determination unit 121 of the control device 120 compares paper information specified by the paper type specifying device 100 with paper information registered in a paper type table 122 (black paper of 11 logΩ/square or more or special high-resistance paper Sb (Sb(1), . . . , and Sb(n)) similar to the black paper and paper Sa (Sa(1), . . . , and Sa(n)) in the present example) not belonging to the special high-resistance paper Sb so as to determine whether or not the paper S to be used belongs to the special high-resistance paper Sb.

Further, in the present example, it is also possible to determine whether or not there is the low-resistance paper Sm (corresponding to paper of 7 log Q/square or less in the present example) among the pieces of paper Sa not belonging to the special high-resistance paper Sb.

In some cases, an example of paper similar to black paper includes paper which is not black but has a gray or dark amber color close to black. These coloring agents may also contain a conductive agent.

Operation of Image Forming Apparatus

Next, in the image forming apparatus illustrated in FIGS. 2 and 3, assuming that the pieces of paper S having different types are mixed and used, after a user selects a required image forming mode, for example, an undercoating image forming mode (a background image+a colored image) on an operation panel (not illustrated), the start switch (not illustrated) may be turned on, and accordingly, printing (the image forming process) by the image forming apparatus is started.

At this time, the paper S is supplied from one of the paper supply containers 81 and 82 or the manual paper feeding device 95 and transported toward the secondary transfer region TR via a predetermined transporting path, and in the middle of transport before the paper S reaches the secondary transfer region TR, the measurement device 110 performs a process of measuring a paper type. In addition to the process of measuring a paper type by the measurement device 110, the user may perform an operation of instructing a paper type on the paper type instruction device 101.

In the present example, a paper type determination process is performed before image formation by each of the image forming units 22 (22*a* to 22*f*).

In the present example, it is determined whether or not the paper S is the special high-resistance paper Sb which is paper having poor transferability. In a case of the paper Sa not belonging to the special high-resistance paper Sb, a first control mode is performed, and in a case of the special high-resistance paper Sb, a second control mode is performed.

Figure 10A:
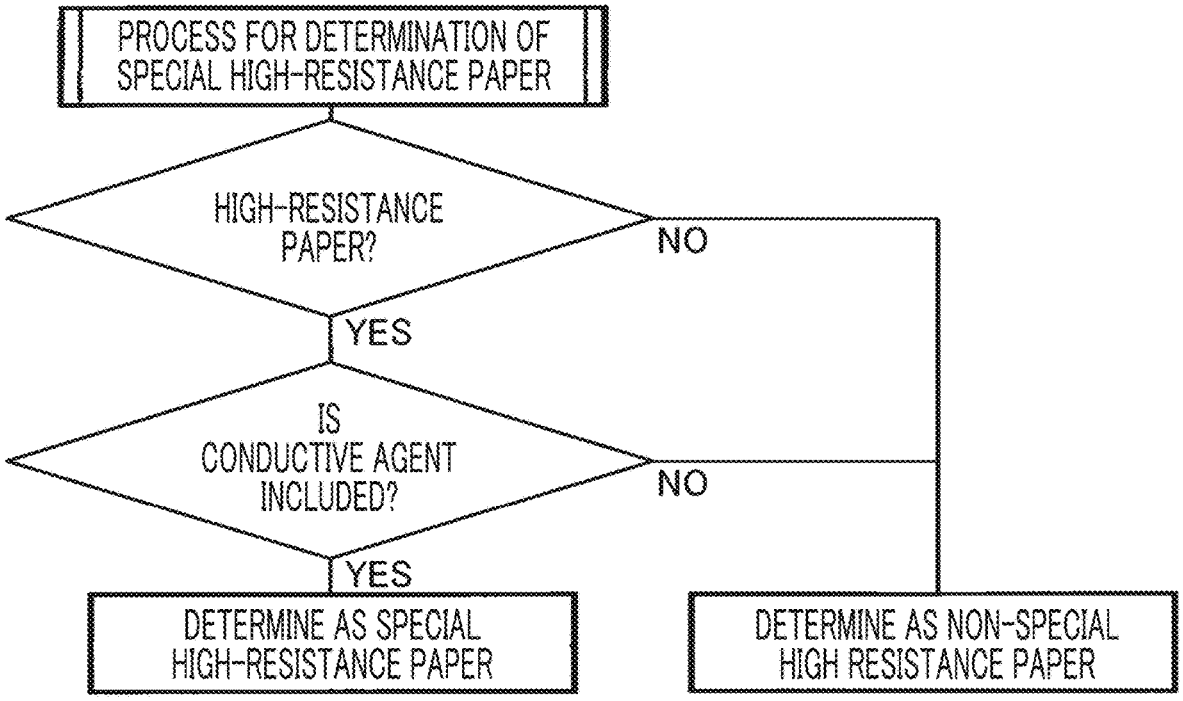
FIG. 10A is an explanatory diagram illustrating Determination Process Example 1 of a piece of special high-resistance paper.

In the present example, as illustrated in FIG. 10A, in a process of determining the special high-resistance paper Sb, in a case where the paper S is high-resistance paper of 11 logΩ/square or more and belongs to a paper group (for example, any one of the pieces of special high-resistance paper Sb registered in the paper type table 122 in FIG. 4A) including a conductive agent such as carbon black, the paper S is determined as the special high-resistance paper Sb, and when the paper S does not belong to the case, the paper S is determined as the non-special high resistance paper Sa.

Figure 10B:
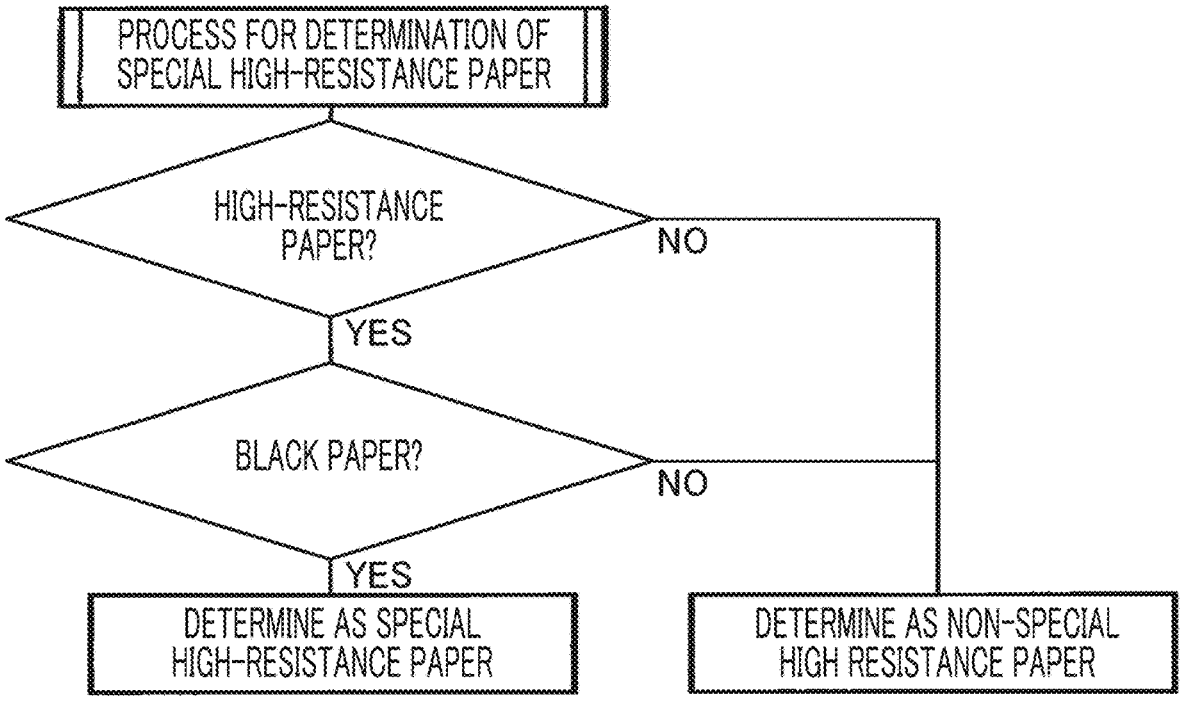
FIG. 10B is an explanatory diagram illustrating Determination Process Example 2 of the special high-resistance paper.

In addition, assuming that the special high-resistance paper Sb to be used is mostly black paper, in the process of determining the special high-resistance paper Sb, as illustrated in FIG. 10B, in a case where the paper S is a high-resistance paper of 11 logΩ/square or more and belongs to a paper group (for example, any one of the pieces of special high-resistance paper Sb registered in the paper type table 122 in FIG. 4A) which is black paper, it is determined as the special high-resistance paper Sb, and when the paper S does not belong to the case, it is determined as the non-special high resistance paper Sa.

First Control Mode

Figure 11A:
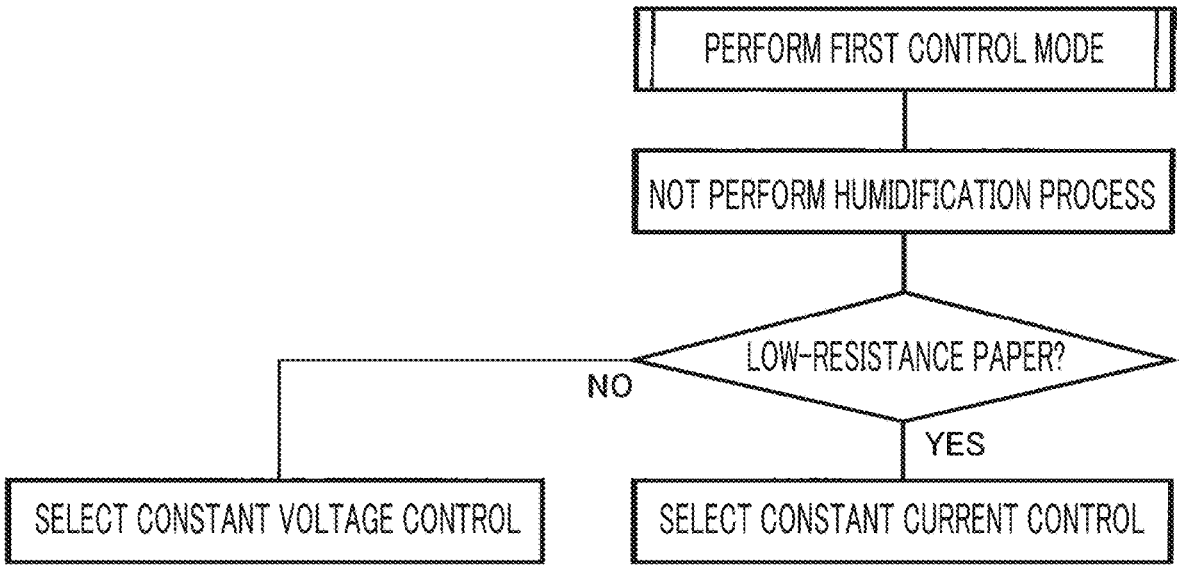
FIG. 11A is an explanatory diagram illustrating a process example of a first control mode.

In the present example, as illustrated in FIG. 11A, the first control mode is executed in a case of the non-special high resistance paper Sa, and the humidification process by the humidifier 130 is not performed, and further, it is determined whether or not the target paper is the low-resistance paper Sm. In a case of the low-resistance paper Sm, the constant current control is selected for the transfer electric-field in the secondary transfer region TR, and in a case where the target paper is not the low-resistance paper Sm, the constant voltage control is selected for the transfer electric-field in the secondary transfer region TR.

Under the secondary transfer condition, the color image $G_{YMCK}$ as a colored image with each color component (YMCK) toner using all or some of the image forming units 22*b* to 22*e* illustrated in FIG. 2 on the intermediate transfer body 30, for example, the color image $G_{MC}$ is formed. The white image Gw as a background image by white (W) toner using the image forming unit 22*f* illustrated in FIG. 2 is formed on the color image $G_{MC}$ ($G_{YMCK}$). The white image Gw and the color image $G_{MC}$ ($G_{YMCK}$) is electrostatically transferred onto the non-special high resistance paper Sa by the transfer electric-field under the constant current control or the constant voltage control in the secondary transfer region TR.

Second Control Mode

Figure 11B:
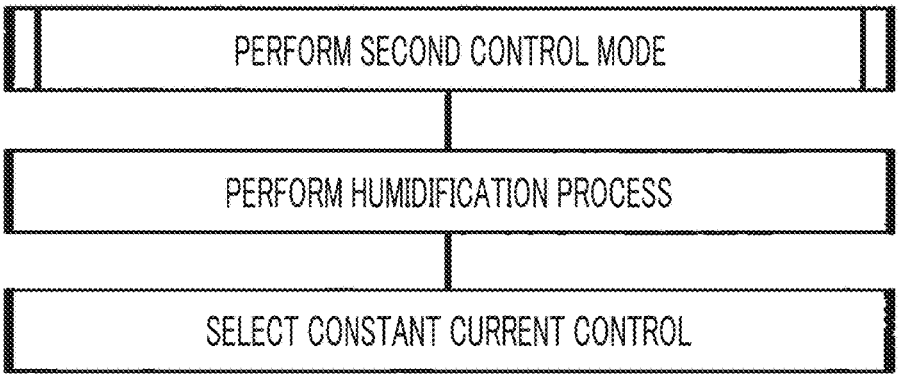
FIG. 11B is an explanatory diagram illustrating a process example of a second control mode.

In the present example, as illustrated in FIG. 11B, the second control mode is executed in a case of the special high-resistance paper Sb, the humidification process by the humidifier 130 is performed, and then, the constant current control may be selected for the transfer electric-field in the secondary transfer region TR.

Figure 12A:
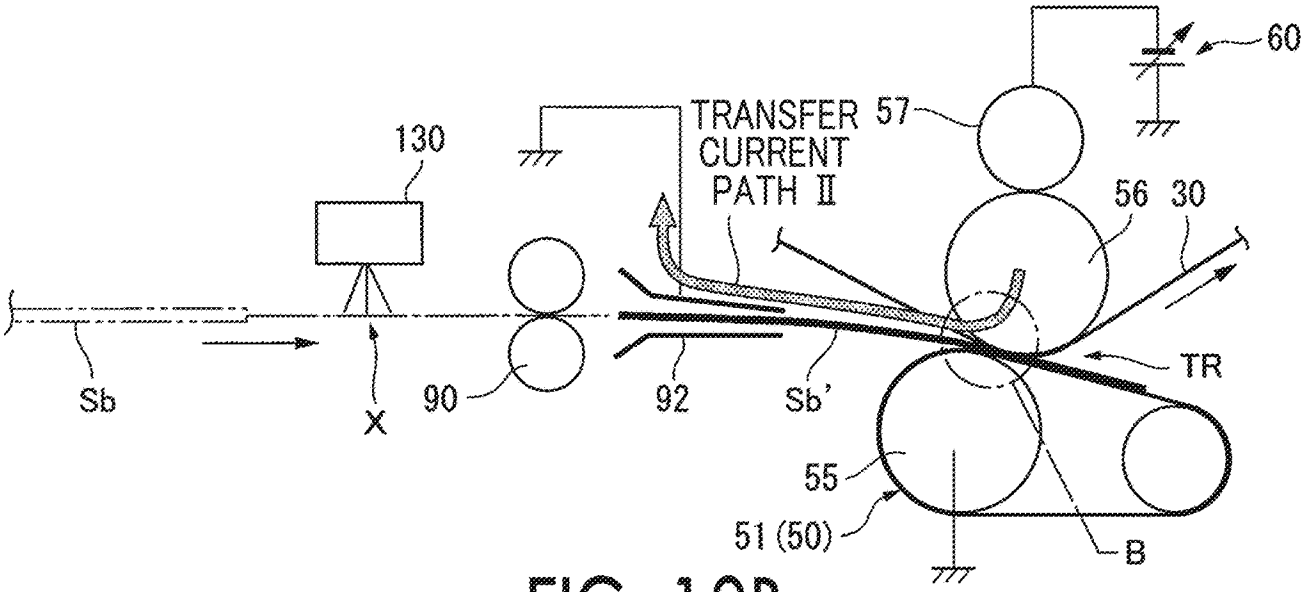
FIG. 12A is an explanatory diagram schematically illustrating the process example of the second control mode.

At this time, as illustrated in FIG. 12A, the humidifier 130 performs the humidification process on the special high-resistance paper Sb in the middle of the transport path toward the secondary transfer region TR, and mist-like water as the humidifying material Z is sprayed on the image holding surface of the special high-resistance paper Sb. For this reason, in a case where the special high-resistance paper Sb passes through the humidification region X by the humidifier 130, a surface resistivity of the special high-resistance paper Sb is greatly reduced by the humidification. As a result, the special high-resistance paper Sb becomes a special high-resistance paper Sb' of a surface resistivity of 7 logΩ·cm or less (corresponding to the low-resistance paper Sm). In this state, the special high-resistance paper Sb' reaches the secondary transfer region TR via the aligning roll 90 and the guide chute 92, and the constant current control is selected for the transfer electric-field in the secondary transfer region TR, as illustrated in FIG. 6B, creeping transfer is performed by a transfer current path II (see FIG. 6B) along which the transfer current $I_{TR}$ flows from the intermediate transfer body 30 to the guide chute 92 via a surface of the special high-resistance paper Sb' (corresponding to the low-resistance paper Sm).

In such a transfer operation process, the white image Gw and the color image $G_{MC}$ ($G_{YMCK}$) formed on the intermediate transfer body 30 are electrostatically transferred onto the special high-resistance paper Sb' by the transfer electric-field under the constant current control in the secondary transfer region TR.

Figure 12B:
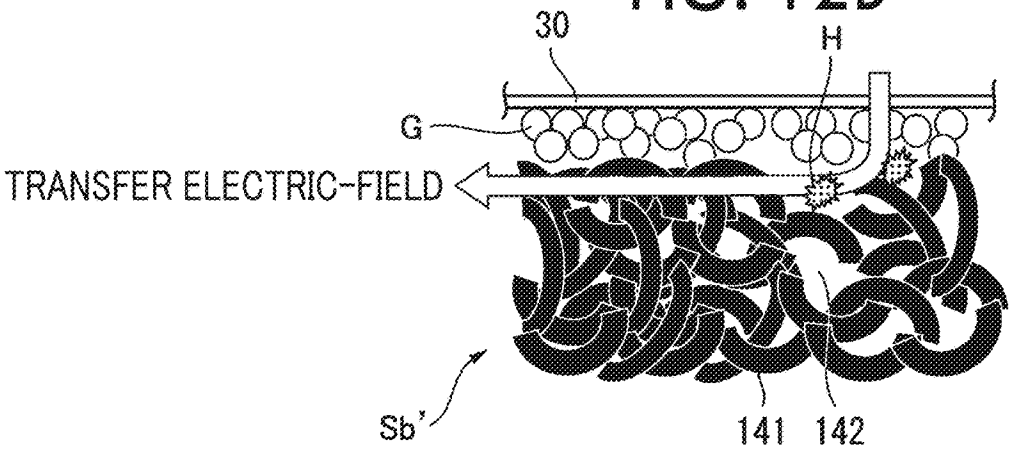
FIG. 12B is an explanatory diagram schematically illustrating a transfer example at a portion B in FIG. 12A.

As described above, in the second control mode, as illustrated in FIG. 12B, regarding the special high-resistance paper Sb' after the humidification, the transfer current $I_{TR}$ flows along the surface of the paper, so that a large transfer electric-field does not act on of the paper in a thickness direction. Therefore, regarding the special high-resistance paper Sb' after the humidification, there is almost no concern that abnormal discharge occurs inside the paper, and image distortion due to the abnormal discharge is not seen in the secondary transfer region TR.

Comparative Embodiment 1

In order to describe that a transfer operation in the second control mode is effective, the image forming apparatus according to Comparative Embodiment 1 will be described as an example.

Figure 13A:
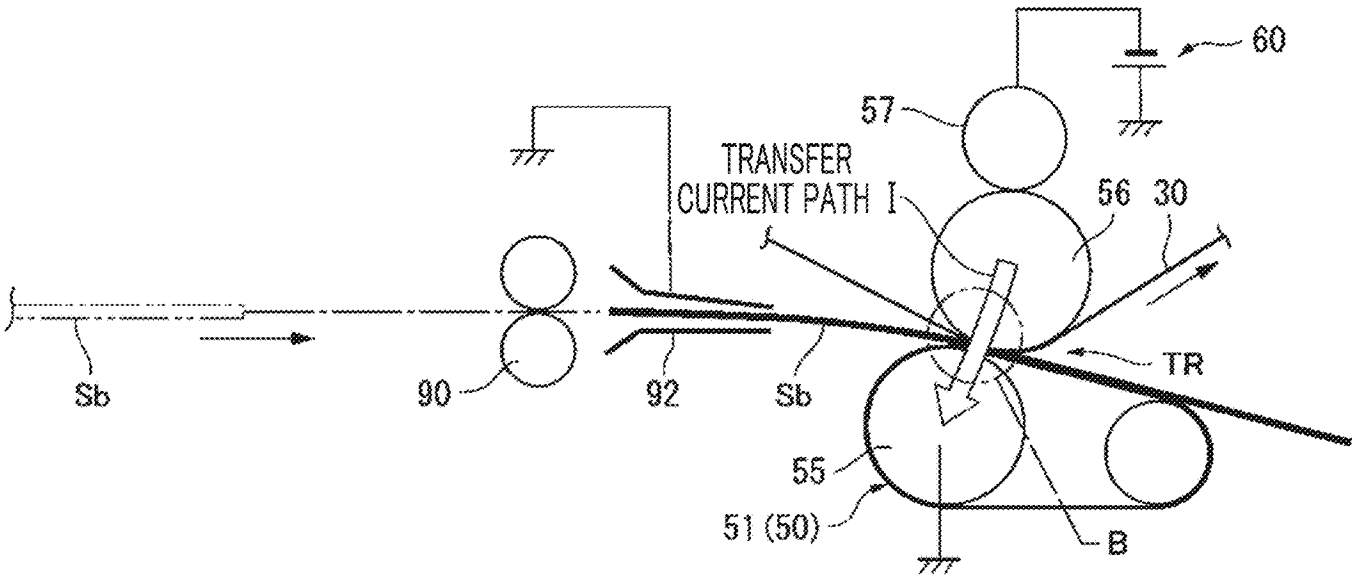
FIG. 13A is an explanatory diagram schematically illustrating a process example when the first control mode is performed on a piece of special high-resistance paper in an image forming apparatus according to Comparative Embodiment 1.

In the image forming apparatus according to Comparative Embodiment 1, as illustrated in FIG. 13A, the special high-resistance paper Sb is transported to the secondary transfer region TR without the humidification process by the humidifier 130, and the transfer operation is performed by the transfer electric-field under that constant voltage control in the secondary transfer region TR.

In the present example, since a surface resistivity of the special high-resistance paper Sb is high, in a case where the transfer electric-field under the constant voltage control is applied in the secondary transfer region TR, opposite transfer is performed by the transfer current path I along which the transfer current $I_{TR}$ flows from the facing roll 56 toward a side of the belt transfer module 51 across the special high-resistance paper Sb.

Therefore, in Comparative Embodiment 1, a large transfer electric-field acts on the special high-resistance paper Sb in the thickness direction of the paper.

Figure 13B:
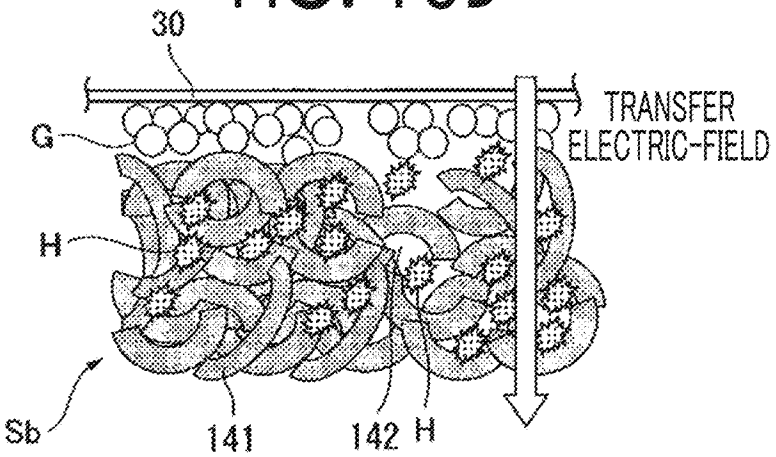
FIG. 13B is an explanatory diagram schematically illustrating a transfer operation at a portion B in FIG. 13A when a piece of rough paper such as Japanese paper or a cardboard is used as special high-resistance paper.

Here, in a case where the special high-resistance paper Sb is a piece of rough paper such as Japanese paper or a cardboard, for example, as illustrated in FIG. 13B, since many cavities 142 exist between fibers 141 inside the paper, abnormal discharge H easily occurs in a cavity 142 between the fibers 141 inside the paper by the transfer electric-field acting in the thickness direction of the paper and there is a concern that image distortion due to the abnormal discharge H may occur in the secondary transfer region TR. Specifically, transferability of toner in a portion at which the abnormal discharge H occurs is lowered, and a part of the image G directly attached to a surface of the intermediate transfer body 30 remains untransferred on the surface of the intermediate transfer body 30. There is a concern that a part of the image G transferred to the special high-resistance paper Sb may be missing.

Figure 13C:
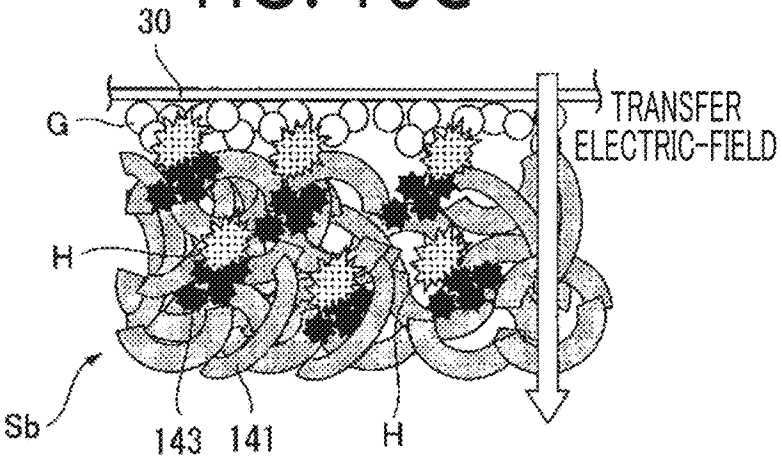
FIG. 13C is an explanatory diagram schematically illustrating a transfer operation at a portion B in FIG. 13A when a piece of black paper is used as the special high-resistance paper.

In a case where the special high-resistance paper Sb is a high-resistance paper such as black paper, as illustrated in FIG. 13C, there is a high possibility that an aggregate of the conductive agent 143 such as carbon black may exist in some of the fibers 141 inside the paper. If a large transfer electric-field acts on the paper in the thickness direction, the abnormal discharge H may easily occur near the aggregate of the conductive agent 143, and image distortion due to the abnormal discharge H may occur in the secondary transfer region TR.

Exemplary Embodiment 2

Figure 14:
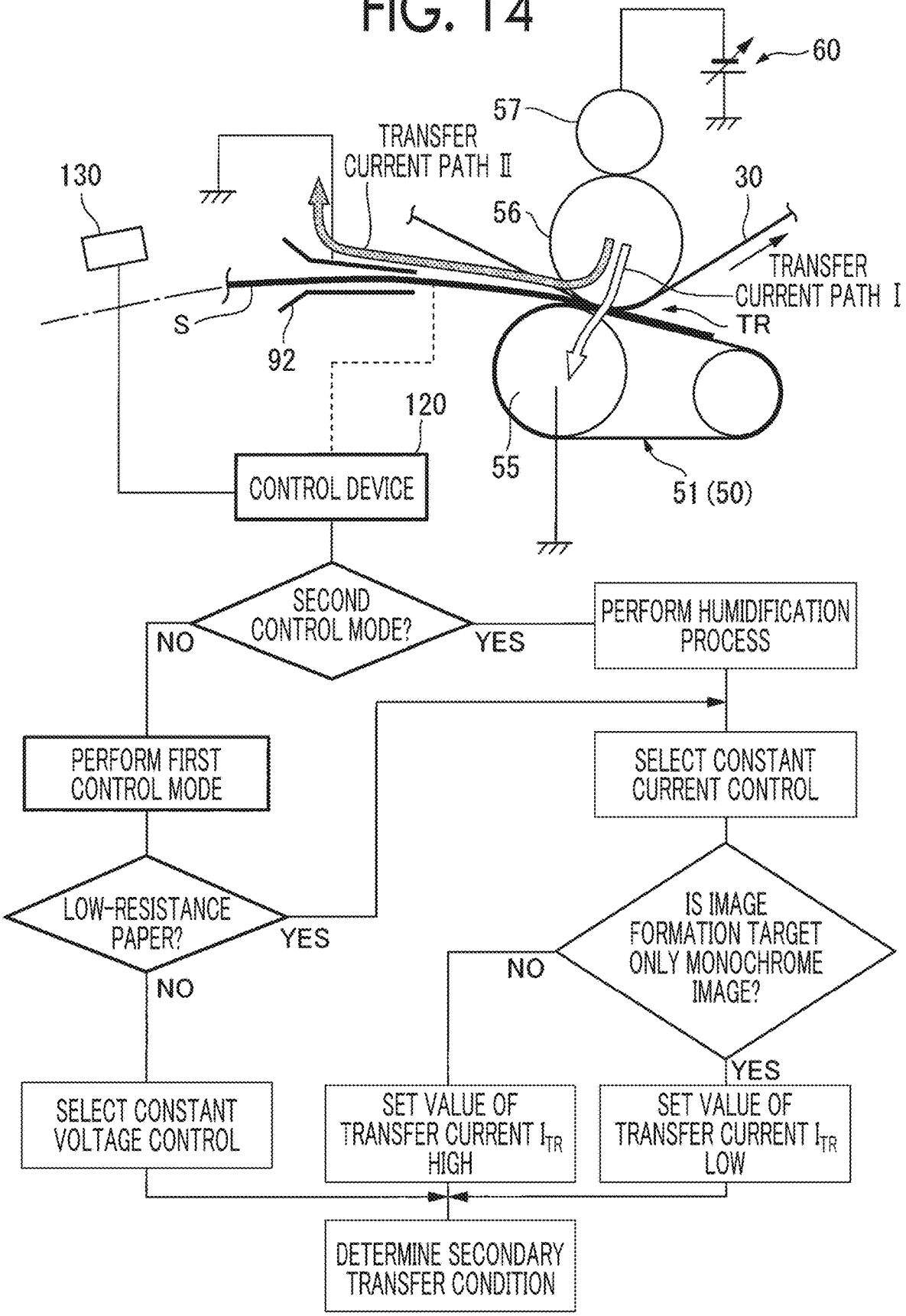
FIG. 14 is an explanatory diagram schematically illustrating a paper type image forming sequence used in an image forming apparatus according to Exemplary Embodiment 2.

FIG. 14 is an explanatory diagram illustrating a basic portion of a paper type image forming sequence of the image forming apparatus according to Exemplary Embodiment 2.

In FIG. 14, a basic configuration of the paper type image forming sequence is approximately the same as that of Exemplary Embodiment 1, but unlike Exemplary Embodiment 1, in a case where the constant current control in the second control mode is selected, a setting value of the transfer current I a is made different in consideration of a type of an image formation target.

Specifically, in a case where the image formation target is only a monochromatic image (for example, the white color image Gw), a setting value of the transfer current $I_{TR}$ is set lower as compared with a case where a multicolor image (for example, the color image $G_{MC}$+the white image Gw) is included. In a case where the image formation target includes the multicolor image (only the multicolor image or a combination of the multicolor image and the monochromatic image), the setting value of the transfer current $I_{TR}$ is set higher as compared with a case of only the monochromatic image. In the present example, in the same manner as Exemplary Embodiment 1, in a case of the low-resistance paper Sm, a method of selecting the constant current control is adopted even in the first control mode.

Setting Method of Transfer Current

In the present exemplary embodiment, in a case of selecting the constant current control, it is necessary to set the transfer current $I_{TR}$ necessary for the secondary transfer region TR so as to appropriately perform a transfer operation in the secondary transfer region TR.

Figure 15:
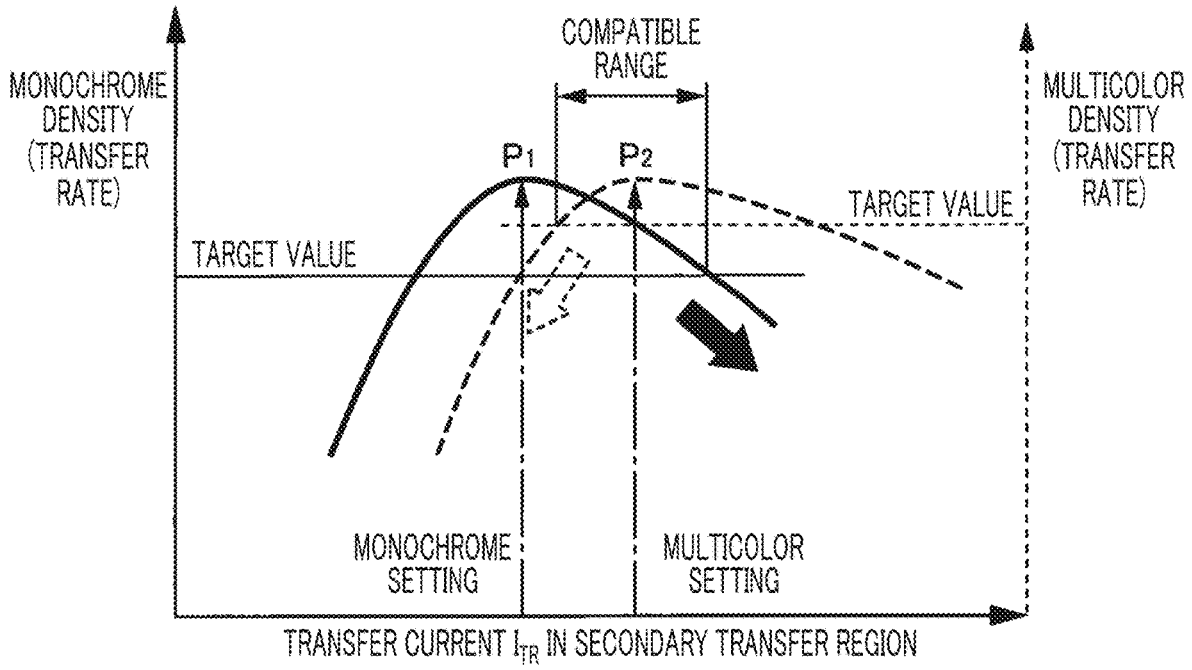
FIG. 15 is an explanatory diagram illustrating a concept of setting a transfer current in a secondary transfer region.

As illustrated in FIGS. 6A and 6B, in a case where an image forming mode is the multicolor mode or the monochrome mode, since layer thicknesses of transfer target images (a multicolor image (for example, the color image $G_{MC}$+the white image Gw), a monochromatic image (for example, the white image Gw)) are different from each other, a relationship between the transfer current $I_{TR}$ in the secondary transfer region TR and a transfer rate (the multicolor image and a density transfer rate of the monochromatic image) is examined, and the result illustrated in FIG. 15 is obtained.

In FIG. 15, in a case of the monochromatic image (for example, the white image Gw), a curvilinear change tendency that the transfer rate gradually increases after the transfer current $I_{TR}$ increases and gradually decreases after passing a peak point P1 is illustrated. The transfer rate is equal to or larger than a target value within a predetermined range across the peak point P1. On the other hand, also in a case of the multicolor image (for example, the color image $G_{MC}$+the white image Gw), a relationship between the transfer current $I_{TR}$ and the transfer ratio indicates a change tendency similar to that in the case of the monochromatic image. As compared with the change curve in the case of the monochromatic image, a value of the transfer current $I_T$m is shifted higher as a whole, and the value of the transfer current $I_{TR}$ is higher at a position of a peak point P2 as compared with the peak point P1.

For any image forming mode, from the viewpoint of obtaining the transfer rate equal to or higher than the target value, the value of the transfer current $I_{TR}$ may be set within a compatible range illustrated in FIG. 15. Meanwhile, in the present example, a value of the transfer current $I_{TR}$ is made different according to the image forming mode.

In the present example, as illustrated in FIG. 15, a transfer rate of the monochromatic image or the multicolor image depends on a value of the transfer current $I_T$m. Since the peak point P1 of the transfer rate of the monochromatic image is shifted to the lower side in which the transfer current $I_T$ is lower than at the peak point P2 of the multicolor image, in a case where the transfer current $I_{TR}$ is set low (for example, set near the peak point P1 of the transfer rate) when printing the monochromatic image (the image forming process), it is possible to obtain a transfer rate closer to an optimal transfer rate.

Exemplary Embodiment 3

Figure 16:
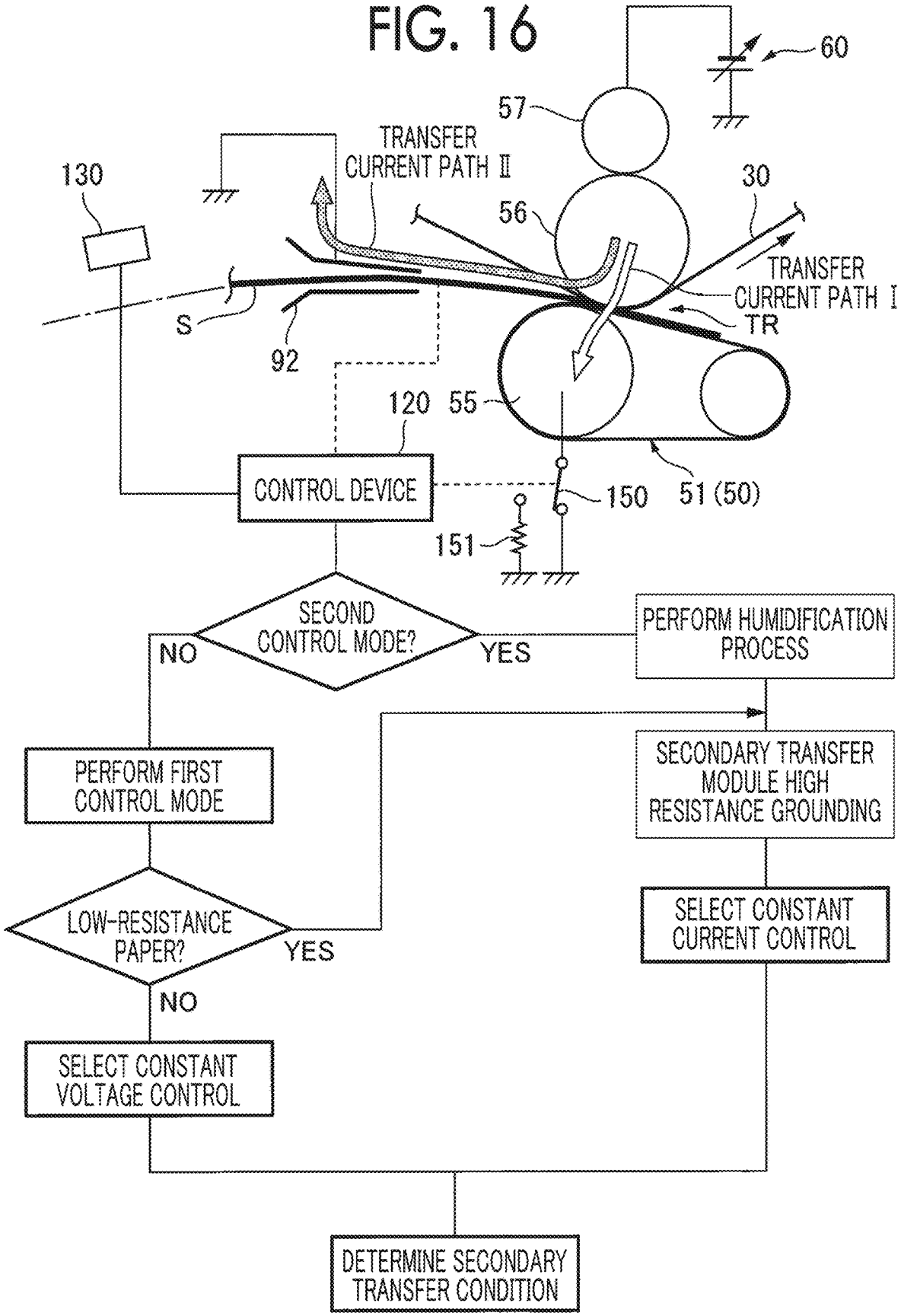
FIG. 16 is an explanatory diagram schematically illustrating a paper type image forming sequence used in an image forming apparatus according to Exemplary Embodiment 3.

FIG. 16 is an explanatory diagram illustrating a basic portion of a paper type image forming sequence of the image forming apparatus according to Exemplary Embodiment 3.

In FIG. 16, a basic configuration of the paper type image forming sequence is approximately the same as that of Exemplary Embodiment 1, but unlike Exemplary Embodiment 1, the elastic transfer roll 55 of the belt transfer module 51 is grounded directly or with a low resistance equal to or less than a predetermined resistance value and a changeover switch 150 is interposed between the elastic transfer roll 55 and the ground, and the changeover switch 150 can switch between the elastic transfer roll 55 being grounded with a high resistance 151 equal to or higher than a predetermined resistance value and the elastic transfer roll 55 not being grounded.

In the present example, when the first control mode is executed, the belt transfer module 51 may be grounded in principle with a low resistance, and when the second control mode is selected, the changeover switch 150 may be switched for the belt transfer module 51 being grounded with a high resistance. In the present example, even in the first control mode, in a case of the low-resistance paper Sm of 7 logΩ·cm or less, for example, switching to high resistance grounding is performed via the changeover switch 150.

According to the present example, the transfer operation by the transfer electric-field under the constant current control is performed on the special high-resistance paper Sb in the secondary transfer region TR after the humidification process by the humidifier 130, and creeping transfer by the transfer current path II is performed (see FIG. 6B).

At this time, since the belt transfer module 51 is ground with a high-resistance via the high resistance 151, a system resistance of the transfer current path I is set to be larger than a system resistance of the transfer current path II as compared with the low resistance grounding. Therefore, in the special high-resistance paper Sb' after the humidification, there is no leakage of a part of the transfer current $I_{TR}$ flowing through the transfer current path II to the transfer current path I (see FIG. 6A), and it is possible to stabilize the system resistance of the transfer current path II.

In addition, in the first control mode, for paper other than the low-resistance paper Sm, the belt transfer module 51 is grounded with a low-resistance and the constant voltage control is selected, and a transfer operation by the transfer electric-field under the constant voltage control is performed in the secondary transfer region TR. For the low-resistance paper Sm, the belt transfer module 51 is grounded with a high-resistance and the constant current control is selected, and a transfer operation by the transfer electric-field under the constant current control is performed in the secondary transfer region TR.

EXAMPLES

Example 1

The present example is an example of the image forming apparatus according to Exemplary Embodiment 1, and in a case where the second control mode is performed on the special high-resistance paper Sb, a transfer performance required to enable the creeping transfer by the transfer current path II (see FIG. 6B) is evaluated for the humidified special high-resistance paper Sb'.

Figure 17:
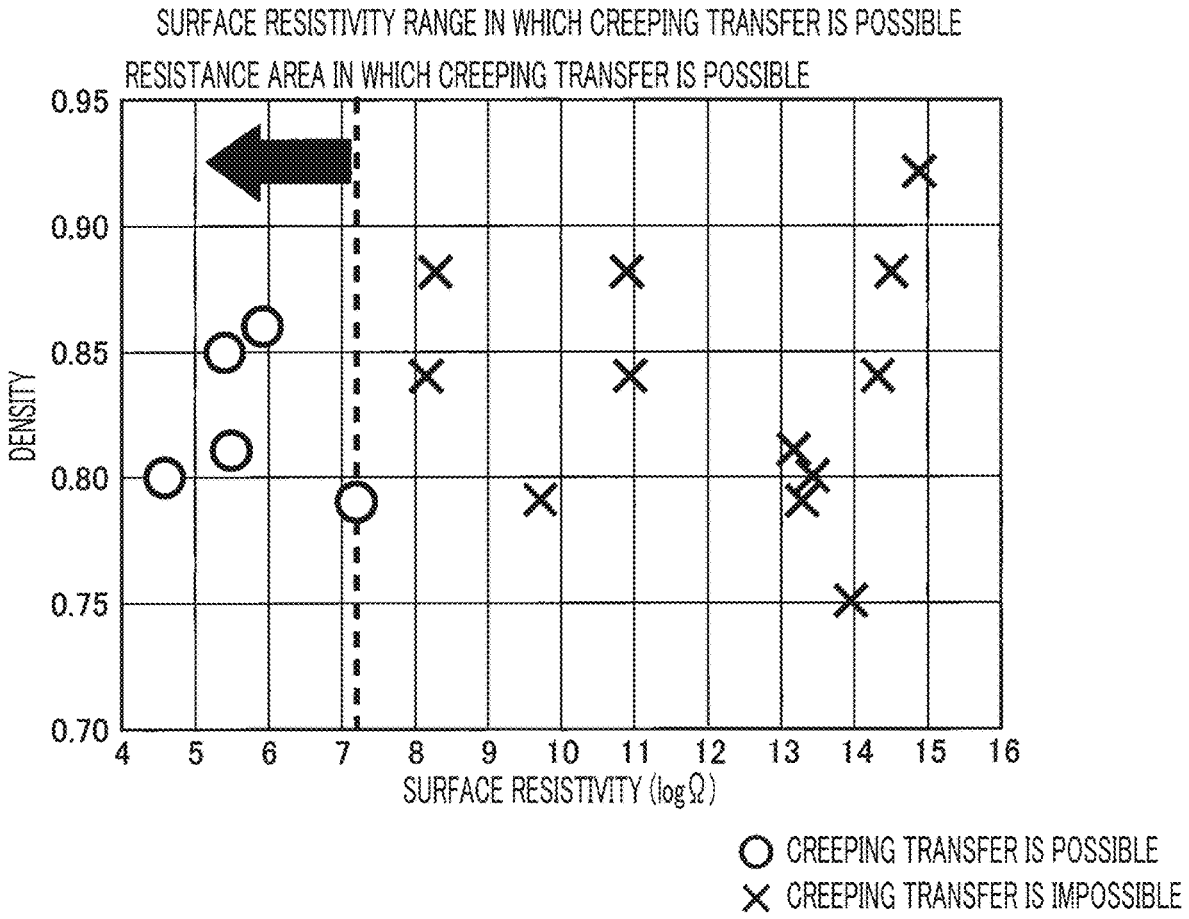
FIG. 17 is an explanatory diagram in which, in using an image forming apparatus according to Example 1, a surface resistivity range of various types of creeping transferable paper can be examined.

In the present example, whether or not the creeping transfer can be performed on various types of pieces of paper having different surface resistivities and different densities is examined, and the results illustrated in FIG. 17 is obtained.

According to FIG. 17, the creeping transfer is possible as long as the paper is the low-resistivity paper Sm having a surface resistivity of 7 logΩ·cm or less, for example. For this reason, even in a case of the special high-resistance paper Sb of 11 logΩ·cm or more, the humidification process by the humidifier 130 is performed in the second control mode, so that the creeping transfer is possible as long as the surface resistance is approximately the same as the low-resistance paper Sm.

Comparative Example 1

In the present comparative example, a quality of the transferred image when the first control mode is performed instead of the second control mode on the special high-resistance paper Sb is evaluated.

Figure 18:
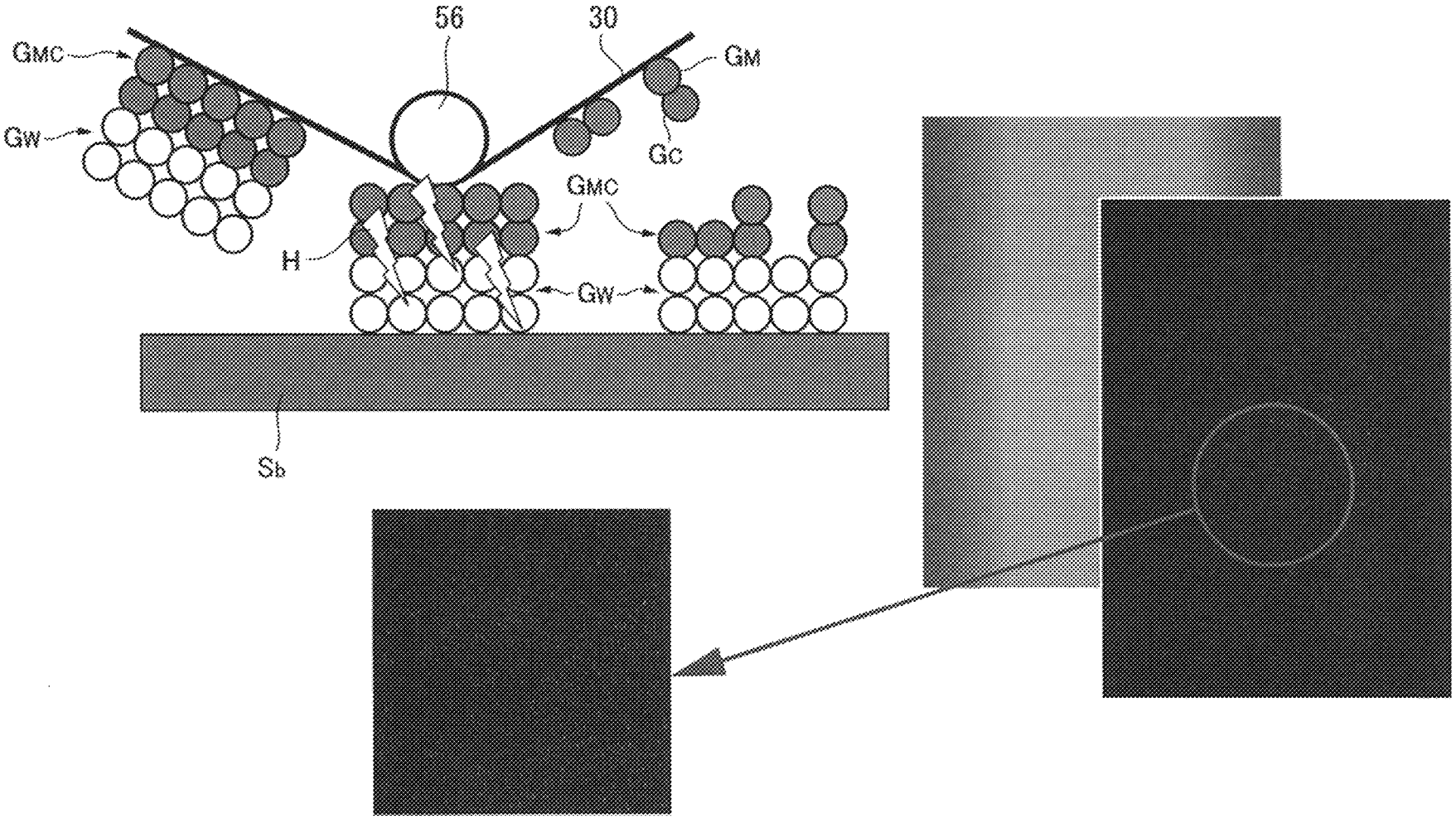
FIG. 18 is an explanatory diagram schematically illustrating a transfer state when a multicolor image is secondarily transferred to a piece of black paper as a piece of special high-resistance paper without a humidification process by using an image forming apparatus according to Comparative Example 1.

In the present example, as illustrated in FIG. 18, the color image $G_{YMCK}$ (the color (blue) image $G_{MC}$ using magenta (M) and cyan (C) toners in the present example) and the white image Gw are formed on the intermediate transfer body 30, and the formed image is transferred to the special high-resistance paper Sb.

In the present example, as the image on the special high-resistance paper Sb after the transfer is examined, a part of the color (blue) image $G_{MC}$ as the color image $G_{YMCK}$ (magenta toner $G_M$ and cyan toner $G_C$) remains on the intermediate transfer body 30, so that a part of the color (blue) image $G_{MC}$ after the transfer is partly missing due to the remaining and a transfer failure is noticeable.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding section that holds an image;

a transfer section that includes a transfer member disposed in contact with an image holding surface of the image holding section and an opposite member disposed at a position facing the transfer member across the image holding section, connects a transfer power supply to the opposite member to apply a transfer electric-field to a transfer region between the image holding section and the transfer member, and electrostatically transfers the image held by the image holding section onto a recording medium transported to the transfer region;

contact sections that are provided upstream and downstream of the recording medium a direction of transport of the recording medium across the transfer region and act as electrodes to ground while being in contact with the recording medium when the recording medium passes through the transfer region;

a humidification section that is provided upstream of the transfer region in the direction of transport of the recording medium and humidifies the recording medium;

a first control section that performs control to transfer the image on the image holding section to the recording medium without humidification by the humidification section, and selects one of constant voltage control or constant current control for the transfer electric-field produced based on a resistance value of the recording medium;

a second control section that performs control to cause the humidification section to humidify the recording medium, to transport the humidified recording medium to the transfer region, and to transfer the image on the image holding section to the recording medium through a transfer current path from the opposite member to the contact section via the recording medium;

a selection section that selects the first control section or the second control section depending on a type of the recording medium; and a determination section capable of determining a type of the recording medium transported toward the transfer region, wherein the selection section selects the first control section or the second control section based on a result of determination by the determination section, and the selection section selects the second control section when the recording medium has a high resistance equal to or more than a predetermined resistance value and includes a medium base containing a conductive agent.

2. The image forming apparatus according to claim 1, wherein the second control section performs constant current control for the transfer electric-field produced by the transfer section.

3. The image forming apparatus according to claim 2, wherein the second control section sets different currents for the transfer electric-field produced by the transfer section depending on whether the image held by the image holding section is a monochromatic image or a multicolor image.

4. The image forming apparatus according to claim 1, wherein the selection section selects the second control section when the recording medium has a high resistance equal to or more than a predetermined resistance value and is black.

5. The image forming apparatus according to claim 1, wherein the selection section selects the second control section when the recording medium has a high resistance equal to or more than a predetermined resistance value and includes a medium base containing carbon black.

6. The image forming apparatus according to claim 1, wherein the selection section selects the second control section when the recording medium has a high resistance equal to or more than a predetermined resistance value and the image held by the image holding section includes a planar background image formed with an opaque background image-forming agent.

7. The image forming apparatus according to claim 1, wherein the first control section performs control to transfer the image on the image holding section to the recording medium through a transfer current path from the opposite member to the transfer member.

8. The image forming apparatus according to claim 7, wherein when the first control section is selected, the transfer member is grounded directly or with a low resistance equal to or less than a predetermined resistance value, and when the second control section is selected, the transfer member is grounded with a high resistance equal to or higher than the predetermined resistance value.

9. The image forming apparatus according to claim 1, wherein the first control section performs control to transfer the image on the image holding section to the recording medium through a transfer current path from the opposite member to the contact section via the recording medium.

10. The image forming apparatus according to claim 1, wherein the humidification section humidifies an image holding surface of the recording medium.

11. The image forming apparatus according to claim 1, wherein the humidification section is provided in a middle of a transport path for the recording medium transported from an accommodation section in which the recording medium is accommodated.

12. An image forming apparatus comprising:

an image holding section that holds an image;

a transfer section that includes a transfer member disposed in contact with an image holding surface of the image holding section and an opposite member disposed at a position facing the transfer member across the image holding section, connects a transfer power supply to the opposite member to apply a transfer electric-field to a transfer region between the image holding section and the transfer member, and electrostatically transfers the image held by the image holding section onto a recording medium transported to the transfer region;

contact sections that are provided upstream and downstream of the recording medium a direction of transport of the recording medium across the transfer region and act as electrodes to ground while being in contact with the recording medium when the recording medium passes through the transfer region;

a humidification section that is provided upstream of the transfer region in the direction of transport of the recording medium and humidifies the recording medium;

a first control section that performs control to transfer the image on the image holding section to the recording medium without humidification by the humidification section;

a second control section that performs control to cause the humidification section to humidify the recording medium, to transport the humidified recording medium to the transfer region, and to transfer the image on the image holding section to the recording medium through a transfer current path from the opposite member to the contact section via the recording medium; and a selection section that selects the first control section or the second control section depending on a type of the recording medium, wherein the selection section selects the second control section when the recording medium has a high resistance equal to or more than a predetermined resistance value and; the recording medium includes a medium base containing a conductive agent, a medium that is black, a medium base containing carbon black, or the image held by the image holding section includes a planar background image formed with an opaque background image-forming agent.

13. An image forming apparatus comprising:

an image holding section that holds an image;

a transfer section that includes a transfer member disposed in contact with an image holding surface of the image holding section and an opposite member disposed at a position facing the transfer member across the image holding section, connects a transfer power supply to the opposite member to apply a transfer electric-field to a transfer region between the image holding section and the transfer member, and electrostatically transfers the image held by the image holding section onto a recording medium transported to the transfer region;

contact sections that are provided upstream and downstream of the recording medium a direction of transport of the recording medium across the transfer region and act as electrodes to ground while being in contact with the recording medium when the recording medium passes through the transfer region;

a humidification section that is provided upstream of the transfer region in the direction of transport of the recording medium and humidifies the recording medium;

a first control section that performs control to transfer the image on the image holding section to the recording medium without humidification by the humidification section;

a second control section that performs control to cause the humidification section to humidify the recording medium, to transport the humidified recording medium to the transfer region, and to transfer the image on the image holding section to the recording medium through a transfer current path from the opposite member to the contact section via the recording medium; and a selection section that selects the first control section or the second control section depending on a type of the recording medium, wherein when the first control section is selected, the transfer member is grounded directly or with a low resistance equal to or less than a predetermined resistance value, and when the second control section is selected, the transfer member is grounded with a high resistance equal to or higher than the predetermined resistance value.

* * * * *